US006018706A

United States Patent [19]

Huang et al.

[11] Patent Number: 6,018,706

[45] Date of Patent: Jan. 25, 2000

[54] PITCH DETERMINER FOR A SPEECH ANALYZER

[75] Inventors: Jian-Cheng Huang, Lake Worth; Floyd Simpson, Lantana; Xiaojun Li, Boynton Beach, all of Fla.

[73] Assignee: Motorola, Inc., Schaumburg, Ill.

[21] Appl. No.: 08/999,171

[22] Filed: Dec. 29, 1997

Related U.S. Application Data

[62] Division of application No. 08/591,995, Jan. 26, 1995, abandoned.

[51] Int. Cl.[7] ..... G10L 7/06

[52] U.S. Cl. ..... 704/207; 704/223

[58] Field of Search ..... 704/223, 205, 704/206, 207, 208, 222, 219, 220, 200

[56] References Cited

U.S. PATENT DOCUMENTS

| | | | |
|---|---|---|---|
| 4,058,676 | 11/1977 | Wilkes et al. | 704/220 |
| 4,696,038 | 9/1987 | Doddington et al. | 704/219 |
| 4,802,221 | 1/1989 | Jibbe | 704/208 |
| 4,856,068 | 8/1989 | Quatieri et al. | 381/47 |
| 4,885,790 | 12/1989 | McAulay et al. | 381/36 |
| 5,133,010 | 7/1992 | Borth et al. | 704/200 |
| 5,195,166 | 3/1993 | Hardwick et al. | 395/2 |
| 5,216,747 | 6/1993 | Hardwick et al. | 395/2 |
| 5,226,084 | 7/1993 | Hardwick et al. | 381/41 |
| 5,226,108 | 7/1993 | Hardwick et al. | 395/2 |
| 5,327,520 | 7/1994 | Chen | 704/219 |
| 5,384,891 | 1/1995 | Asakawa et al. | 704/220 |
| 5,487,128 | 1/1996 | Ozawa | 704/222 |

*Primary Examiner*—Richemond Dorvil
*Attorney, Agent, or Firm*—Philip P. Macnak

[57] ABSTRACT

A pitch determiner (414) for use with a speech analyzer includes a pitch function generator (414) which generates a plurality of pitch components representing a pitch function for one or more sequential segments of speech. which are represented by a predetermined number of digitized speech samples. A pitch enhancer (1116) enhances the pitch function of a current segment of speech utilizing the pitch function of one or more sequential segments of speech to generate a plurality of enhanced pitch components. A pitch detector (1118) detects the pitch of the current segment of speech by determining the pitch of an enhanced pitch component having a largest amplitude of the plurality of enhanced pitch components.

11 Claims, 17 Drawing Sheets

108

1106

1310

1126

PITCH DETERMINER FOR A SPEECH ANALYZER

This application is a Divisional of U.S. patent application Ser. No. 08/591,995 filed Jan. 26, 1995, now abandoned.

FIELD OF THE INVENTION

This invention relates generally to communication systems, and more specifically to a compressed voice digital communication system using a very low bit rate time domain speech analyzer for voice messaging.

BACKGROUND OF THE INVENTION

Communications systems, such as paging systems, have had to in the past compromise the length of messages, number of users and convenience to the user in order to operate the systems profitably. The number of users and the length of the messages were limited to avoid over crowding of the channel and to avoid long transmission time delays. The user's convenience is directly affected by the channel capacity, the number of users on the channel, system features and type of messaging. In a paging system, tone only pagers that simply alerted the user to call a predetermined telephone number offered the highest channel capacity but were some what inconvenient to the users. Conventional analog voice pagers allowed the user to receive a more detailed message, but severally limited the number of users on a given channel. Analog voice pagers, being real time devices, also had the disadvantage of not providing the user with a way of storing and repeating the message received. The introduction of digital pagers with numeric and alphanumeric displays and memories overcame many of the problems associated with the older pagers. These digital pagers improved the message handling capacity of the paging channel, and provide the user with a way of storing messages for later review.

Although the digital pagers with numeric and alpha numeric displays offered many advantages, some user's still preferred pagers with voice announcements. In an attempt to provide this service over a limited capacity digital channel, various digital voice compression techniques and synthesis techniques have been tried, each with their own level of success and limitation. Voice compression methods, based on vocoder techniques, currently offer a highly promising technique for voice compression. Of the low data rate vocoders, the multi band excitation (MBE) vocoder is among the most natural sounding vocoder.

The vocoder analyzes short segments of speech, called speech frames, and characterizes the speech in terms of several parameters that are digitized and encoded for transmission. The speech characteristics that are typically analyzed include voicing characteristics, pitch, frame energy, and spectral characteristics. Vocoder synthesizers used these parameters to reconstruct the original speech by mimicking the human voice mechanism. Vocoder synthesizers modeled the human voice as an excitation source, controlled by the pitch and frame energy parameters followed by a spectrum shaping controlled by the spectral parameters.

The voicing characteristic describes the repetitiveness of the speech waveform. Speech consists of periods where the speech waveform has a repetitive nature and periods where no repetitive characteristics can be detected. The periods where the waveform has a periodic repetitive characteristic are said to be voiced. Periods where the waveform seems to have a totally random characteristic are said to be unvoiced. The voiced/unvoiced characteristics are used by the vocoder speech synthesizer to determine the type of excitation signal which will be used to reproduce that segment of speech. Due to the complexity and irregularities of human speech production, no single parameter can reliably determine when a speech frame is voiced or unvoiced.

Pitch defines the fundamental frequency of the repetitive portion of the voiced wave form. Pitch is typically defined in terms of a pitch period or the time period of the repetitive segments of the voiced portion of the speech wave forms. The speech waveform is a highly complex waveform and very rich in harmonics. The complexity of the speech waveform makes it very difficult to extract pitch information. Changes in pitch frequency must also be smoothly tracked for an MBE vocoder synthesizer to smoothly reconstruct the original speech. Most vocoders employ a time-domain auto-correlation function to perform pitch detection and tracking. Auto-correlation is a very computationally intensive and time consuming process. It has also been observed that conventional auto-correlation methods are unreliable when used with speech derived from a telephone network. The frequency response of the telephone network (300 Hz to 3400 Hz) causes deep attenuation to the lower harmonics of speech that has a low pitch frequency (the range of the fundamental pitch frequency of the human voice is 50 Hz to 400 Hz). Because of the deep attenuation of the fundamental frequency, pitch trackers can erroneously identify the second or third harmonic as the fundamental frequency. The human auditory process is very sensitive to changes in pitch and the perceived quality of the reconstructed speech is strongly effected by the accuracy of the pitch derived.

Frame energy is a measure of the normalized average RMS power of the speech frame. This parameter defines the loudness of the speech during the speech frame.

The spectral characteristics define the relative amplitude of the harmonics and the fundamental pitch frequency during the voiced portions of speech and the relative spectral shape of the noise-like unvoiced speech segments. The data transmitted defines the spectral characteristics of the reconstructed speech signal. Non optimum spectral shaping results in poor reconstruction of the voice by an MBE vocoder synthesizer and poor noise suppression.

The human voice, during a voiced period, has portions of the spectrum that are voiced and portions that are unvoiced. MBE vocoders produce natural sounding voice because the excitation source, during a voiced period, is a mixture of voiced and unvoiced frequency bands. The speech spectrum is divided into a number of frequency bands and a determination is made for each band as to the voiced/unvoiced nature of each band. The MBE speech synthesizer generates an additional set of data to control the excitation of the voiced speech frames. In conventional MBE vocoders, the band voiced/unvoiced decision metric is pitch dependent and computationally intensive. Errors in pitch will lead to errors in the band voiced/unvoiced decision that will affect the synthesized speech quality. Transmission of the band voiced/unvoiced data also substantially increases the quantity of data that must be transmitted.

Conventional MBE synthesizers require information on the phase relationship of the harmonic of the pitch signal to accurately reproduce speech. Transmission of phase information, further increasing the data required to be transmitted.

Conventional MBE synthesizers can generate natural sounding speech at a data rate of 2400 to 6400 bit per second. MBE synthesizers are being used in a number of commercial mobile communications systems, such as the INMARSAT (International Marine Satellite Organization) and the ASTRO™ portable transceiver manufactured by Motorola Inc. of Schaumburg, Ill. The standard MBE vocoder compression methods, currently used very successfully by two way radios, fail to provide the degree of compression required for use on a paging channel. Voice messages that are digitally encoded using the current state of the art would monopolize such a large portion of the paging channel capacity that they may render the system commercially unsuccessful.

Accordingly, what is needed for optimal utilization of a channel in a communication system, such as a paging channel in a paging system or a data channel in a non-real time one way or two way data communications system, is an apparatus that simply and accurately determines the voiced and unvoiced portions of speech, accurately determines and tracks the fundamental pitch frequency when the frequency spectrum of the fundamental pitch components is severely attenuated, and significantly reduces the amount of data necessary for the transmission of the voiced/unvoiced band information. Also what is needed is an apparatus digitally encodes voice messages in such a way that the resulting data is very highly compressed while maintaining acceptable speech quality and can easily be mixed with the normal data sent over the communication channel.

SUMMARY OF THE INVENTION

Briefly, according to a second aspect of the invention a pitch determiner for use in a speech analyzer determines a pitch within one or more sequential segments of speech, each segment of speech being represented by a predetermined number of digitized speech samples. The pitch determiner includes a pitch function generator, a pitch enhancer, and a pitch detector. The pitch function generator generates, from the digitized speech samples, a plurality of pitch components representing a pitch function. The pitch function defines an amplitude of each of the plurality of pitch components. The pitch enhancer enhances the pitch function of a current segment of speech utilizing the pitch function of one or more sequential segments of speech. The pitch detector detects the pitch of the current segment of speech by determining the pitch of an enhanced pitch component having a largest amplitude of the plurality of enhanced pitch components.

DESCRIPTION OF THE PREFERRED EMBODIMENT

Figure 1:
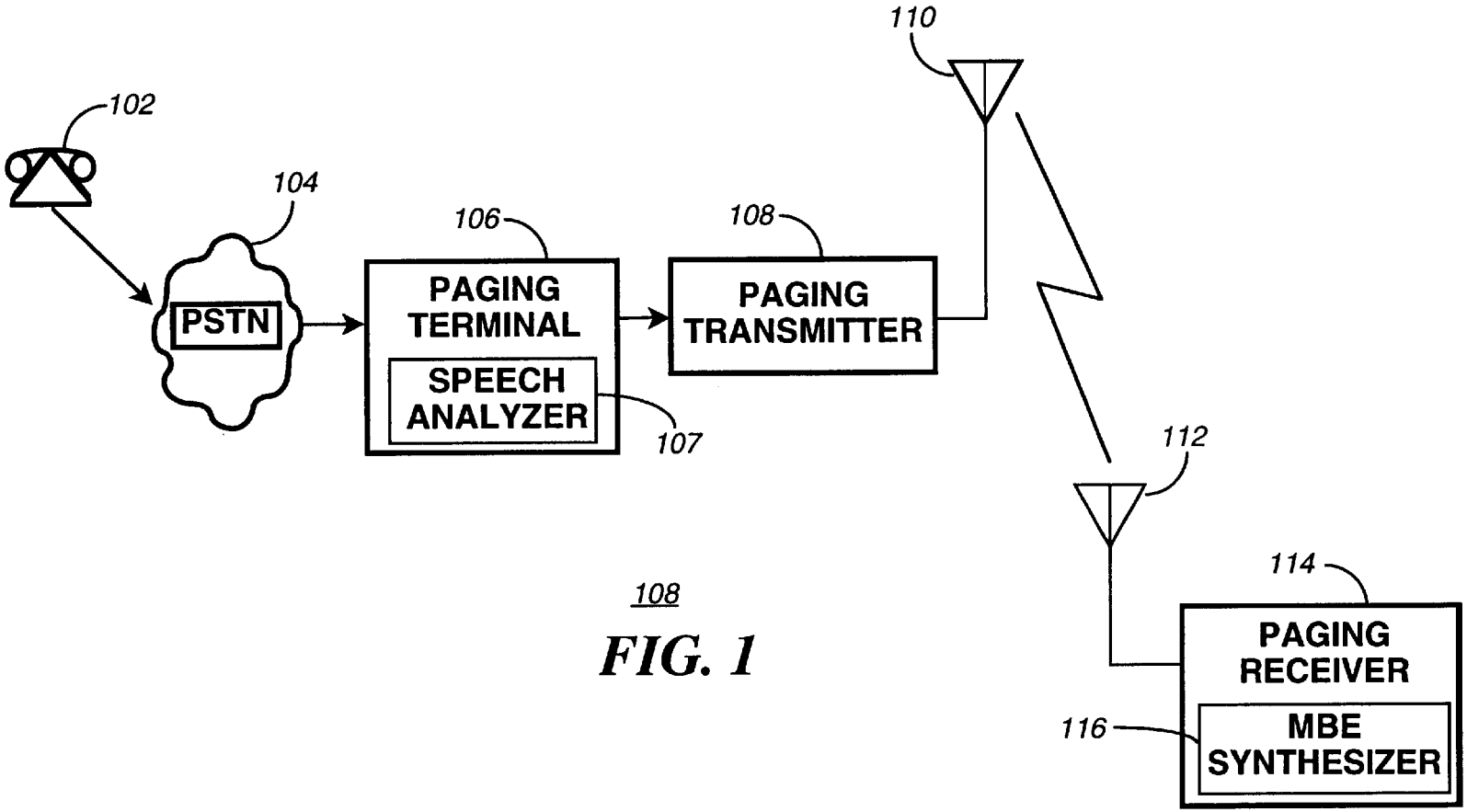
FIG. 1 is a block diagram of a communication system utilizing a very low bit rate time domain speech analyzer for voice messaging in accordance with the present invention.

FIG. 1 shows a block diagram of a communications system, such as a paging or data transmission system, utilizing a very low bit rate time domain speech analyzer for voice messaging in accordance with the present invention. As will be described in detail below, the paging terminal 106 uses an unique speech analyzer 107 to generates excitation parameters and spectral parameters representing the speech data and a communication receiver, such as a paging receiver 114 uses a unique MBE synthesizer 116 to reproduce the original speech.

By way of example, a paging system will be utilized to describe the present invention, although it will be appreciated that any non-real time communication system will benefit from the present invention as well. A paging system is designed to provide service to a variety of users, each requiring different services. Some of the users may require numeric messaging services, other users alpha-numeric messaging services, and still other users may require voice messaging services. In a paging system, the caller originates a page by communicating with a paging terminal 106 via a telephone 102 through a public switched telephone network (PSTN) 104. The paging terminal 106 prompts the caller for the recipient's identification, and a message to be sent. Upon receiving the required information, the paging terminal 106 returns a prompt indicating that the message has been received by the paging terminal 106. The paging terminal 106 encodes the message and places the encoded message into a transmission queue. In the case of a voice message the paging terminal 106 compresses and encodes the message using a speech analyzer 107. At an appropriate time, the message is transmitted using a radio frequency transmitter 108 and transmitting antenna 110. It will be appreciated that in a simulcast transmission system, a multiplicity of transmitters covering different geographic areas can be utilized as well.

The signal transmitted from the transmitting antenna 110 is intercepted by a receiving antenna 112 and processed by a receiver 114, shown in FIG. 1 as a paging receiver, although it will be appreciated that other communication receivers can be utilized as well. Voice messages received are decoded and reconstructed using an MBE synthesizer 116. The person being paged is alerted and the message is displayed or annunciated depending on the type of messaging being employed.

The digital voice encoding and decoding process used by the speech analyzer 107 and the MBE synthesizer 116, described herein, is readily adapted to the non-real time nature of paging and any non-real time communications system. These non-real time communication systems provide the time required to perform a highly computational compression process on the voice message. Delays of up to two minutes can be reasonably tolerated in paging systems, whereas delays of two seconds are unacceptable in real time communication systems. The asymmetric nature of the digital voice compression process described herein minimizes the processing required to be performed at the receiver 114, making the process ideal for paging applications and other similar non-real time voice communications. The highly computational portion of the digital voice compression process is performed in the fixed portion of the system, i.e. at the paging terminal 106. Such operation, together with the use of an MBE synthesizer 116 that operates almost entirely in the frequency domain, greatly reduces the computation required to be performed in the portable portion of the communication system.

The speech analyzer 107 analyzes the voice message and generates spectral parameters and excitation parameters, as will be described below. The spectral parameters generated include information describing the magnitude and phase of all harmonics of a fundamental pitch signal that fall within the communication system's pass band. Pitch changes significantly from speaker to speaker and will change to a lesser extent while a speaker is talking. A speaker having a low pitch voice, such as a man, will have more harmonics then a speaker with a higher pitch voice, such as a woman. In a conventional MBE synthesizer the speech analyzer 107 must derive the magnitude and phase information for each harmonic in order for the MBE synthesizer to accurately reproduce the voice message. The varying number of harmonics results in a variable quantity of data required to be transmitted. As will be described below, the present invention uses fixed dimension LPC analysis and a spectral code book to vector quantize the data into a fixed length index for transmission. In the present invention the speech analyzer 107 does not generate harmonic phase information as in prior art analyzers, but instead the MBE synthesizer 116 uses a unique frequency domain technique to artificially regenerate phase information at the receiver 114. The frequency domain technique also reduces the quantity of computation performed by the MBE synthesizer 116.

The excitation parameters include a pitch parameter, an RMS parameter, and a frame voiced/unvoiced parameter. The frame voiced/unvoiced parameter describes the repetitive nature of the sound. Segments of speech that have a highly repetitive waveform are described as voiced, whereas segments of speech that have a random waveform are described as being unvoiced. The frame voiced/unvoiced parameter generated by the speech analyzer 107 determines whether the MBE synthesizer 116 uses a periodic signal as an excitation source or a noise like signal source as an excitation source. The present invention uses a highly accurate nonlinear classifier at the speech analyzer 107 to determine the frame voiced/unvoiced parameter.

Frames, or segments of speech, that are classified as voiced often have spectral portions that are unvoiced. The speech analyzer 107 and MBE synthesizer 116 produce excellent quality speech by dividing the voice spectrum into a number of sub-bands and including information describing the voiced/unvoiced nature of the voice signal in each sub-band. The sub-band voice/unvoiced parameters, in conventional synthesizers, must be regenerated by the speech analyzer 107 and transmitted to the MBE synthesizer 116. The present invention determines a relationship between the sub-band voiced/unvoiced information and the spectral information and appends a ten band voicing code book containing voiced/unvoiced likelihood parameters to a spectral code book. The index of the ten band voicing code book is the same as the index of the spectral code book, thus only one index need be transmitted. The present invention eliminates the necessity of transmitting the ten bits used by a conventional MBE synthesizer to specify the voiced/unvoiced parameters of each of the ten sub bands as will be described below. The MBE synthesizer 116, at the receiver 114, uses the probabilities provided in the ten band voicing code book along with spectral parameters to determine the voiced/unvoiced parameters for each band.

The pitch parameter defines the fundamental frequency of the repetitive portion of speech. Pitch is measured in vocoders as the period of the fundamental frequency. The human auditory function is very sensitive to pitch, and errors in pitch have a major impact on the perceived quality of the speech reproduced by the MBE synthesizer 116. Communication systems, such as paging systems, that receive speech input via the telephone network have to detect pitch when the fundamental pitch frequency has been severely attenuated by the network. Conventional pitch detectors determine pitch information by use of a highly computational auto-correlation calculations in the time domain, and because of the loss of the fundamental frequency components, sometimes detect the second or third harmonic as the fundamental pitch frequency. In the present invention, a method is employed to regenerate and enhance the fundamental pitch frequency. A frequency domain calculation is used to approximate the pitch frequency and limit the search range of the auto-correlation function to a predetermined range, greatly reducing the auto-correlation calculations. The present invention also utilizes a unique method of regenerating the fundamental pitch frequencies. Pitch information from past and future frames, and a limited auto-correlation search provide a robust pitch detector and tracker capable of detecting and tracking pitch under adverse conditions.

The RMS parameter is a measurement of the total energy of all the harmonics in a frame. The RMS parameter is generated by the speech analyzer 107 and is used by the MBE synthesizer 116 to establish the volume of the reproduced speech.

Figure 2:
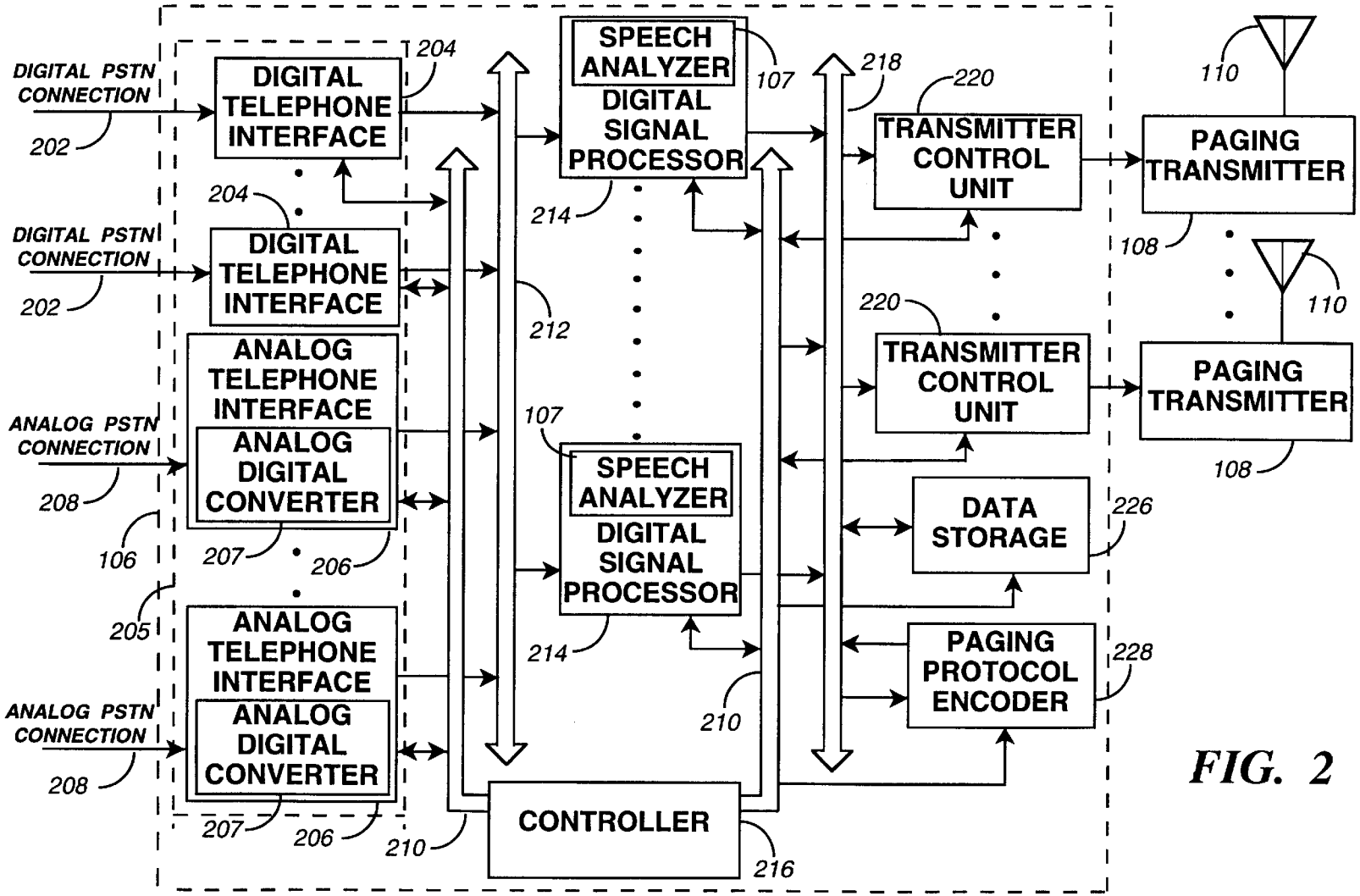
FIG. 2 is a electrical block diagram of a paging terminal and associated paging transmitters utilizing a very low bit rate time domain speech analyzer for voice messaging in accordance with the present invention.

An electrical block diagram of the paging terminal 106 and the radio frequency transmitter 108 utilizing the digital voice compression process in accordance with the present invention is shown in FIG. 2. The paging terminal 106 shown is of a type that would be used to serve a large number of simultaneous users, such as in a commercial Radio Common Carrier (RCC) system. The paging terminal 106 utilizes a number of input devices, signal processing devices and output devices controlled by a controller 216. Communication between the controller 216 and the various devices that make up the paging terminal 106 are handled by a digital control bus 210. Distribution of digitized voice and data is handled by an input time division multiplexed highway 212 and an output time division multiplexed highway 218. It will be appreciated that the digital control bus 210, input time division multiplexed highway 212 and output time division multiplexed highway 218 can be extended to provide for expansion of the paging terminal 106.

An input speech processor section 205 provides the interface between the PSTN 104 and the paging terminal 106. The PSTN connections can be either a plurality of multi-call per line multiplexed digital connections shown in FIG. 2 as a digital PSTN connection 202 or plurality of single call per line analog connections shown in FIG. 2 as an analog PSTN connection 208.

Each digital PSTN connection 202 is serviced by a digital telephone interface 204. The digital telephone interface 204 provides the necessary signal conditioning, synchronization, de-multiplexing, signaling, supervision, and regulatory protection requirements for operation of the digital voice compression process in accordance with the present invention. The digital telephone interface 204 can also provide temporary storage of the digitized voice frames to facilitate interchange of time slots and time slot alignment necessary to provide an access to the input time division multiplexed highway 212. As will be described below, requests for service and supervisory responses are controlled by the controller 216. Communication between the digital telephone interface 204 and the controller 216 passes over the digital control bus 210.

Each analog PSTN connection 208 is serviced by an analog telephone interface 206. The analog telephone interface 206 provides the necessary signal conditioning, signaling, supervision, analog to digital and digital to analog conversion, and regulatory protection requirements for operation of the digital voice compression process in accordance with the present invention. The frames, or segments of speech, digitized by the analog to digital converter 207 are temporary stored in the analog telephone interface 206 to facilitate interchange of time slots and time slot alignment necessary to provide an access to the input time division multiplexed highway 212. As will be described below, requests for service and supervisory responses are controlled by a controller 216. Communication between the analog telephone interface 206 and the controller 216 passes over the digital control bus 210.

When an incoming call is detected, a request for service is sent from the analog telephone interface 206 or the digital telephone interface 204 to the controller 216. The controller 216 selects a digital signal processor 214 from a plurality of digital signal processors. The controller 216 couples the analog telephone interface 206 or the digital telephone interface 204 requesting service to the digital signal processor 214 selected via the input time division multiplexed highway 212.

The digital signal processor 214 can be programmed to perform all of the signal processing functions required to complete the paging process, including the function of the speech analyzer 107. Typical signal processing functions performed by the digital signal processor 214 include digital voice compression using the speech analyzer 107 in accordance with the present invention, dual tone multi frequency (DTMF) decoding and generation, modem tone generation and decoding, and pre-recorded voice prompt generation. The digital signal processor 214 can be programmed to perform one or more of the functions described above. In the case of a digital signal processor 214 that is programmed to perform more then one task, the controller 216 assigns the particular task needed to be performed at the time the digital signal processor 214 is selected, or in the case of a digital signal processor 214 that is programmed to perform only a single task, the controller 216 selects a digital signal processor 214 programmed to perform the particular function needed to complete the next step in the process. The operation of the digital signal processor 214 performing dual tone multi frequency (DTMF) decoding and generation, modem tone generation and decoding, and pre-recorded voice prompt generation is well known to one of ordinary skill in the art. The operation of the digital signal processor 214 performing the function of speech analyzer 107 in accordance with the present invention is described in detail below.

The processing of a page request, in the case of a voice message, proceeds in the following manner. The digital signal processor 214 that is coupled to an analog telephone interface 206 or a digital telephone interface 204 then prompts the originator for a voice message. The digital signal processor 214 compresses the voice message received using a process described below. The compressed digital voice message generated by the compression process is coupled to a paging protocol encoder 228, via the output time division multiplexed highway 218, under the control of the controller 216. The paging protocol encoder 228 encodes the data into a suitable paging protocol. One such encoding method is the inFLEXion™ protocol, developed by Motorola Inc. of Schaumburg, Ill., although it will be appreciated that there are many other suitable encoding methods that can be utilized as well, for example the Post Office Code Standards Advisory Group (POCSAG) code. The controller 216 directs the paging protocol encoder 228 to store the encoded data in a data storage device 226 via the output time division multiplexed highway 218. At an appropriate time, the encoded data is downloaded into the transmitter control unit 220, under control of the controller 216, via the output time division multiplexed highway 218 and transmitted using the radio frequency transmitter 108 and the transmitting antenna 110.

In the case of numeric messaging, the processing of a page request proceeds in a manner similar to the voice message with the exception of the process performed by the digital signal processor 214. The digital signal processor 214 prompts the originator for a DTMF message. The digital signal processor 214 decodes the DTMF signal received and generates a digital message. The digital message generated by the digital signal processor 214 is handled in the same way as the digital voice message generated by the digital signal processor 214 in the voice messaging case.

The processing of an alpha-numeric page proceeds in a manner similar to the voice message with the exception of the process performed by the digital signal processor 214. The digital signal processor 214 is programmed to decode and generate modem tones. The digital signal processor 214 interfaces with the originator using one of the standard user interface protocols such as the Page Entry Terminal (PET™)

protocol. It will be appreciated that other communications protocols can be utilized as well. The digital message generated by the digital signal processor 214 is handled in the same way as the digital voice message generated by the digital signal processor 214 in the voice messaging case.

Figure 3:
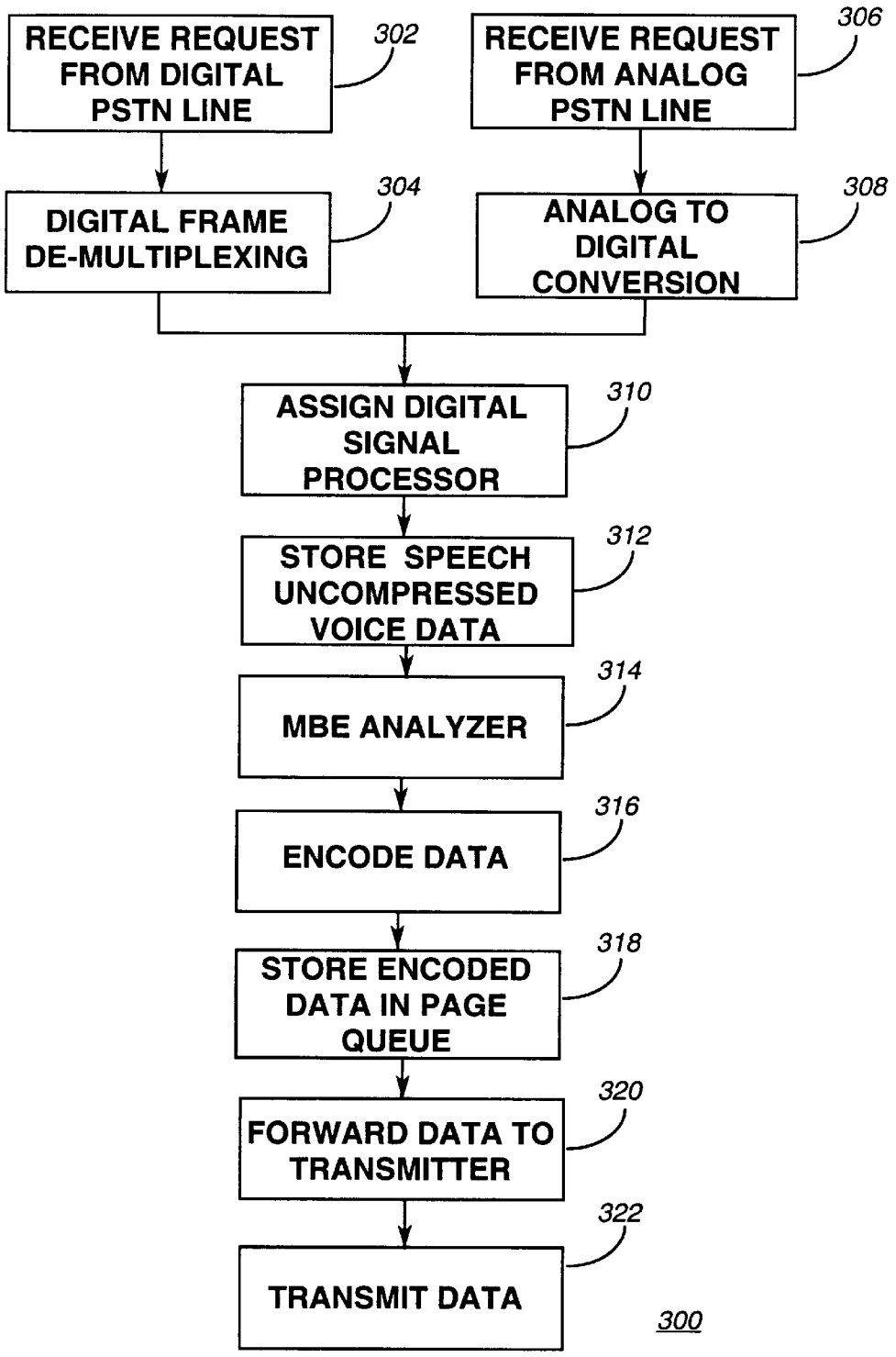
FIG. 3 is a flow chart showing the operation of the paging terminal of FIG. 2.

FIG. 3 is a flow chart which describes the operation of the paging terminal 106 and the speech analyzer 107 shown in FIG. 2 when processing a voice message. There are shown two entry points into the flow chart 300. The first entry point is for a process associated with the digital PSTN connection 202 and the second entry point is for a process associated with the analog PSTN connection 208. In the case of the digital PSTN connection 202, the process starts with step 302, receiving a request over a digital PSTN line. Requests for service from the digital PSTN connection 202 are indicated by a bit pattern in the incoming data stream. The digital telephone interface 204 receives the request for service and communicates the request to the controller 216.

In step 304, information received from the digital channel requesting service is separated from the incoming data stream by digital frame de-multiplexing. The digital signal received from the digital PSTN connection 202 typically includes a plurality of digital channels multiplexed into an incoming data stream. The digital channel requesting service is de-multiplexed and the digitized speech data is then stored temporary to facilitate time slot alignment and multiplexing of the data onto the input time division multiplexed highway 212. A time slot for the digitized speech data on the input time division multiplexed highway 212 is assigned by the controller 216. Conversely, digitized speech data generated by the digital signal processor 214 for transmission to the digital PSTN connection 202 is formatted suitably for transmission and multiplexed into the outgoing data stream.

Similarly with the analog PSTN connection 208, the process starts with step 306 when a request from the analog PSTN line is received. On the analog PSTN connection 208, incoming calls are signaled by either low frequency AC signals or by DC signaling. The analog telephone interface 206 receives the request and communicates the request to the controller 216.

In step 308, the analog voice message is converted into a digital data stream by the analog to digital converter 207 which functions as a sampler for generating voice message samples and a digitizer for digitizing the voice message samples. The analog signal received over its total duration is referred to as the analog voice message. The analog signal is sampled, generating voice samples and then digitized, generating digitized speech samples, by the analog to digital converter 207. The samples of the analog signal are referred to as speech samples. The digitized voice samples are referred to as digital speech data. The digital speech data is multiplexed onto the input time division multiplexed highway 212 in a time slot assigned by the controller 216. Conversely any voice data on the input time division multiplexed highway 212 that originates from the digital signal processor 214 undergoes a digital to analog conversion before transmission to the analog PSTN connection 208.

As shown in FIG. 3, the processing path for the analog PSTN connection 208 and the digital PSTN connection 202 converge in step 310, when a digital signal processor is assigned to handle the incoming call. The controller 216 selects a digital signal processor 214 programmed to perform the digital voice compression process. The digital signal processor 214 assigned reads the data on the input time division multiplexed highway 212 in the previously assigned time slot.

The data read by the digital signal processor 214 is stored as frames, or segments of speech, for processing, in step 312, as uncompressed speech data. The stored uncompressed speech data is processed by the speech analyzer 107 at step 314, which will be described in detail below. The compressed voice data derived from the speech analyzer at step 314 is encoded suitably for transmission over a paging channel, in step 316. In step 318, the encoded data is stored in a paging queue for later transmission. At the appropriate time the queued data is sent to the radio frequency transmitter 108 at step 320 and transmitted, at step 322.

Figure 4:
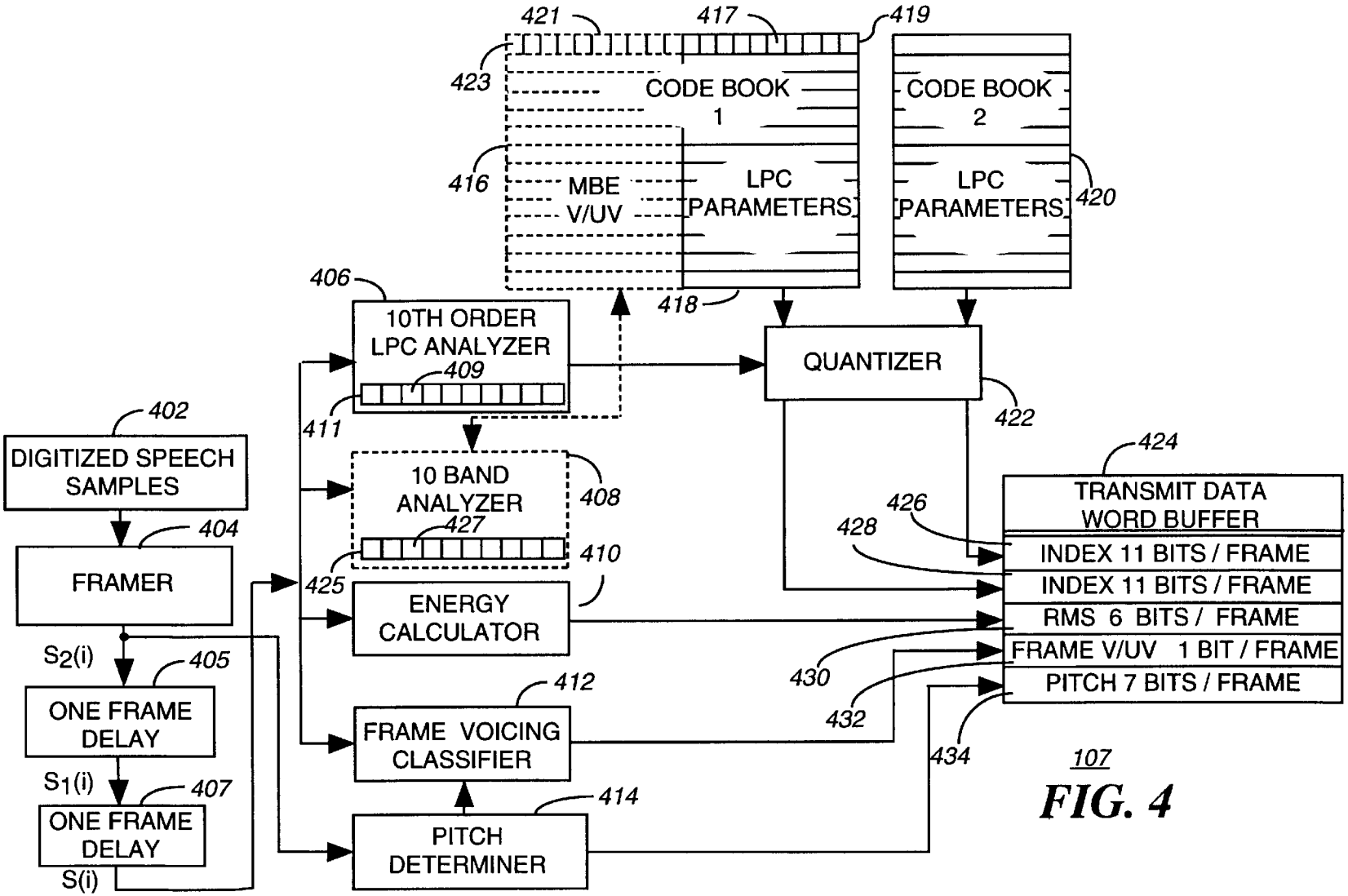
FIG. 4 is an data flow diagram showing an over view of the speech analyzer used in the paging terminal shown in FIG. 1 and of the data flow between functions.

FIG. 4 is a block diagram showing an overview of the data flow in the speech analyzer process at step 314. Stored digitized speech samples 402 herein called speech data, that were stored in step 312 are retrieved from the memory and coupled to a framer 404. The framer 404 segments the speech data into adjacent frames which by way of example is two hundred digitized speech samples within a window of two hundred and fifty-six digitized speech samples that are centered on the current frame and overlapping the previous and future frame. The output of the framer 404 is coupled to a pitch determiner 414. The output of the framer 404 is also coupled to a delay 405 which provides a one frame delay and which in turn is coupled to a second one frame delay 407. The one frame delay 405 and the second one frame delay 407 delays and buffers the output of the framer 404 to match the delay through the pitch determiner 414 as will be described below. The output of the second one frame delay 407 is coupled to a LPC analyzer 406, an energy calculator 410, and a frame voicing classifier 412.

During the development of an MBE voicing code book 416, the output of the second one frame delay 405 is also coupled to a ten band voicing analyzer 408. The ten band voicing analyzer 408 is coupled to an MBE voicing code book 416. The MBE voicing code book 416 is not used by the paging terminal 106 during normal operation and it is not necessary for the MBE voicing code book 416 to be stored at the paging terminal 106. The MBE voicing code book 416 is used by the receiver 114 as is described in copending U.S. patent application Ser. No. (Attorney's Docket No. PT02122U).

The LPC analyzer 406 is coupled to a quantizer 422. The quantizer 422 is coupled to a first spectral code book 418 and a second residue code book 420. The quantizer 422 generates a first eleven bit index 426 and a second eleven bit index 428 that is the quantization of the spectral information of the speech frame from the second one frame delay 407. The first eleven bit index 426 and a second eleven bit index 428 are stored in a thirty-six bit transmit data buffer 424 for transmission.

The output of the energy calculator 410 is six bit RMS data 430 and is a measurement of the energy of the speech frame from the second one frame delay 407. The six bit RMS data 430 is stored in the thirty-six bit transmit data buffer 424 for transmission.

The output of the frame voicing classifier 412 is a single bit per frame voiced/unvoiced data word 432 defining the voiced/unvoiced characteristics of the speech frame from the second one frame delay 407. The single bit per frame voiced/unvoiced data word 432 is stored in the thirty six bit transmit data buffer 424 for transmission.

The output of the pitch determiner 414 is a seven bit pitch data word 434 and is a measurement of the pitch of the speech frame generated by the framer 404. The seven bit pitch data word 434 is stored in the thirty six bit transmit data buffer 424 for transmission. The pitch determiner 414 is also coupled to the frame voicing classifier 412. Some of the intermediate results of the pitch calculations by the pitch determiner 414 are used by the frame voicing classifier 412 in the determination of the frame voiced/unvoiced characteristics.

In the preferred embodiment of the present invention the data generated from three frames of speech samples are stored in buffers. The frame of speech samples that has been delayed by the duration of two frames is referred to herein as the current frame. The speech analyzer 107 analyzes the speech data after a two frame delay to generate the speech parameter representing the current segment of speech. The three frames of speech stored in the buffers contain speech from the current frame, two future frames relative to the current frame, and previous results from two past frames relative to the current frame. The speech analyzer 107 analyzes frames of speech data in the future to establish trends such that current parameters will be consistent with future trends. The output of the framer 404 $S_2(i)$ is delayed by one frame time by the one frame delay 405 to generate $S_1(i)$. The output of the one frame delay 405 $S_1(i)$ is delayed again by the second one frame delay 407 to generate S(i). S(i) is referred to herein as the current frame. Because the frame $S_1(i)$ comes one frame after the current S(i)then, $S_1(i)$ is in the future relative to S(i) and $S_1(i)$ is referred to herein as the first future frame. In the same manner $S_2(i)$ comes two frames after the current frame S(i) and $S_2(i)$ is referred to herein as the second future frame.

The LPC analyzer 406 performs a tenth order LPC analysis on the current frame of speech data to generate ten LPC spectral parameters 409. The ten LPC spectral parameters 409 are coefficients of a tenth order polynomial representing the magnitude of the harmonics contained in the speech frame. The LPC analyzer 406 arranges the ten LPC spectral parameters 409 into a spectral vector 411.

The quantizer 422 quantizes the spectral vector 411 generated by the LPC analyzer 406 into two eleven bit code words. The vector quantization function utilizes a plurality of predetermined spectral vectors identified by a plurality of indexes, comprising a spectral code book 418, which is stored in a memory in the digital signal processor 214. Each predetermined spectral vector 419 of the spectral code book 418 is identified by an eleven bit index and preferably contains ten spectral parameters 417. The spectral code book 418 preferably contains 2048 predetermined spectral vectors. The vector quantization function compares the spectral vector 411 with every predetermined spectral vector 419 in the spectral code book 418 and calculates a set of distance values representing distances between the spectral vector 411 and each predetermined spectral vector 419. The first distance calculated and it's index is stored in a buffer. Then as each additional distance is calculated it is compared with the distance stored in the buffer and when a shorter distance is found, that distance and index replaces the previous distance and index. The index of the predetermined spectral vector 419 having a shortest distance to the spectral vector 411 is selected in this manner. The quantizer 422 quantizes the spectral vector 411 in two stages. The index selected is a first stage result.

In the second stage, the difference between the predetermined spectral vector 419 selected in stage one and the spectral vector 411 is determined. The difference is referred to as the residue spectral vector. The residue spectral vector is compared with a set of predetermined residue vectors. The set of predetermined residue vectors, comprise a second code book, or residue code book 420, and is also stored in the digital signal processor 214. The distance between the residue spectral vector and each predetermined residue vector of the residue code book 420 is calculated. The distance 433 and the corresponding index 429 of each distance calculation is stored in an index array 431. The index array 431 is searched and the index of the predetermined spectral vector of the second residue code book 420 having a shortest distance to the residue spectral vector, is selected. The index selected is the second stage result.

The eleven bit first stage result becomes the first eleven bit index 426 and the eleven bit second stage result becomes the second eleven bit index 428 that are stored in the thirty-six bit transmit data buffer 424 for transmission. The transmit data buffer 424 is also referred to herein as an output buffer.

The distance between a spectral vector 411 and a predetermined spectral vector 419 is typically calculated using a weighted sum of squares method. This distance is calculated by subtracting the value of one of the ten LPC spectral parameters 409 in a spectral vector 411 from a value of the corresponding predetermined spectral parameter 417 in the predetermined spectral vector 419, squaring the result and multiplying the squared result by a corresponding weighting value from a calculated weighting array. The value of the calculated weighting array is calculated from the spectral vector using a procedure well known to one ordinarily skilled in the art. This calculation is repeated on every parameter of the ten LPC spectral parameters 409 in the spectral vector 411 and the corresponding predetermined spectral parameter 417 in the predetermined spectral vector 419. The sum of the result of these calculations is the distance between the predetermined spectral vector 419 and the spectral vector 411. In the preferred embodiment of the present invention, the values of the parameters of the predetermined weighting array have been determined empirically by a series of listening tests.

The distance calculation described above can be shown by the following formula, $$d_i = \sum_h w_h (a_h - b(k))_h^2$$

where:

b is a preselected code book, $d_i$ equals the distance between the spectral vector and the predetermined spectral vector of a code book b, $W_h$ equals the weighting value of parameter h of the calculated weighting array, $a_h$ equals the value of the parameter h of the spectral vector, $b(k)_h$ equals the parameter h in predetermined spectral vector k of the code book b, and h is a index designating parameters in the spectral vector or the corresponding parameter in the speech parameter template.

As described above, a set of two eleven bit code books is utilized, however it will be appreciated that more than one code book and code books of different sizes, for example ten bit code books or twelve bit code books, can be used as well. It will also be appreciated that a single code book having a larger number of predetermined spectral vectors and a single stage quantization process can also be used, or that a split vector quantizer which is well known to one or ordinary skill in the art can be use to code the spectral vectors as well. It will also be appreciated that two or more sets of code books representing different dialects or languages can also be provided.

Figure 5:
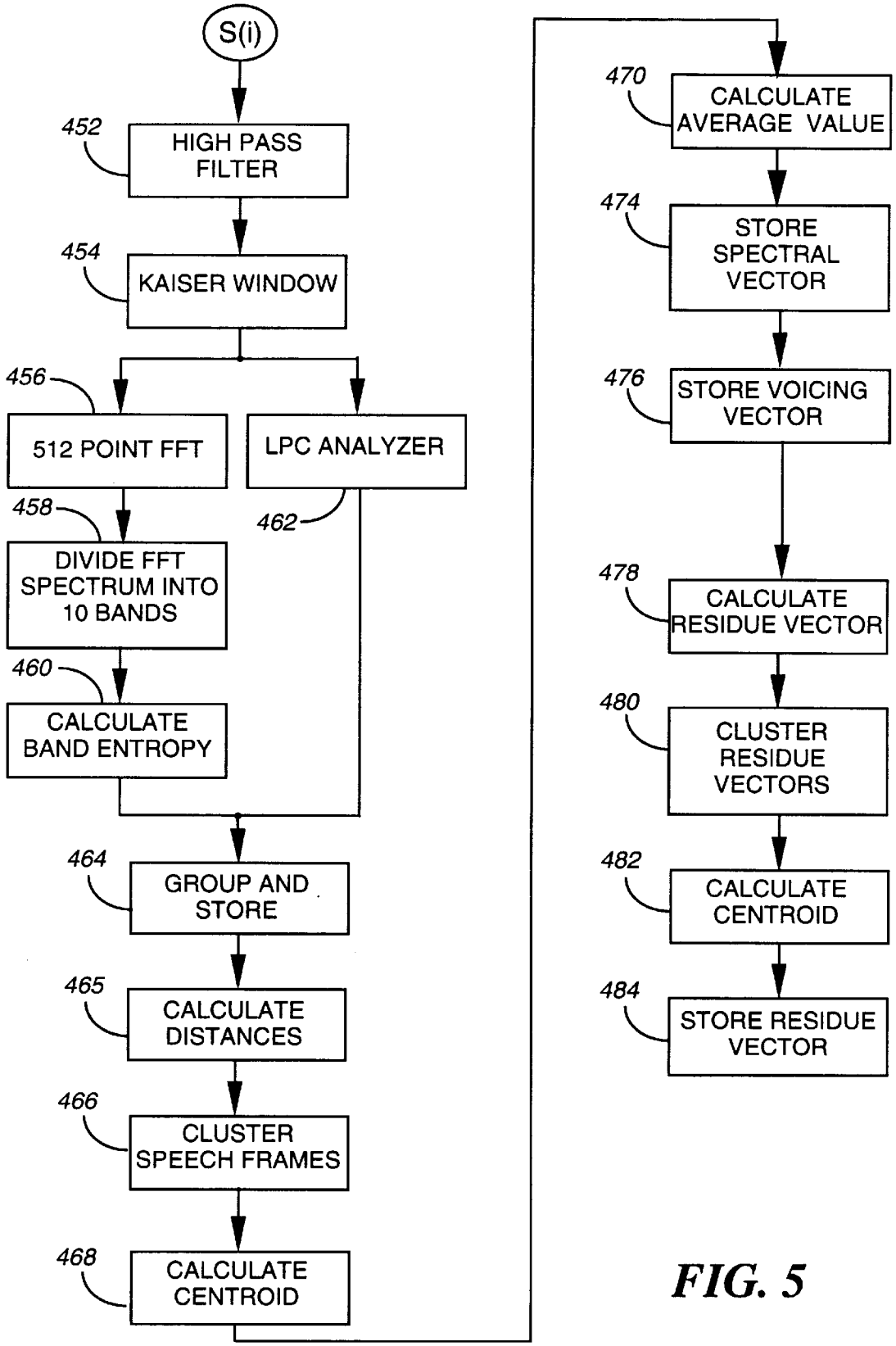
FIG. 5 shows a flow chart describing the development of the code books used in the speech analyzer shown in FIG. 4.

FIG. 5 shows a flow chart describing an empirical training process used in the development of the spectral code book 418, the residue code book 420 and the co-indexed MBE voicing code book 416 which has a predetermined association to the spectral code book 418. The training process analyzes a very large number of segments of speech to generate spectral vectors 411 and voicing vectors 425 representing each segment of speech. The process starts at step 452 where frames of digitized samples S(i) representing the segments of speech are high passed filtered. Next at step 454, the filtered frames are windowed by a 256 point Kaiser window. The parameter of the Kaiser window is preferably set equal to six. The Kaiser window is well known in the art and is used to smooth the effect of the abrupt start and stop that occurs when a frame is analyzed independent of the surrounding speech segments. The windowed frames are then analyzed to determined the spectral and voicing characteristics of each segment of speech. The spectral characteristics are determined at step 462. At step 462 a tenth order LPC analysis is performed on the windowed frames to generate ten LPC spectral parameters 409 for each speech segment. The ten LPC spectral parameters 409 generated are grouped into spectral vectors 411.

The voicing characteristics are determined at steps 456 through step 460. At step 456, a 512 point FFT is used to create a FFT spectrum. At step 458, the frequency spectrum is divided into a plurality bands. In the preferred embodiment of the present invention ten bands are used. Each band of the resulting ten bands of the FFT spectrum is designated by the value of a variable j. Next at step 460, a voicing parameter 427 based on the entropy, $E_j$, described below, of the FFT spectrum within each band, is calculated. Then at step 464, the voicing parameter 427 for the ten bands are grouped into a voicing vector 425 and associated with the corresponding spectral vector 411 and stored.

When the spectral vector 411 and the associated voicing vector 425 for all of the very large number of segments of speech are calculated then at step 465, the distance between the spectral vectors 411 are calculated. The distance is calculated using the distance formula described above. Then at step 466, the spectral vectors 411 that are closer together than a predetermined distance are grouped into clusters. At step 468, a centroid of each cluster is calculated and the vector defining the centroid becomes a predetermined spectral vector 419.

Next at step 470, the ten band predetermined voicing vector 421 is calculated by averaging the voicing vector 425 associated with the spectral vector within a cluster of spectral vectors identified by the predetermined spectral vector 419. The average value is calculated by summing the voicing vectors 425 and then dividing the result by the total number of frames of speech grouped together in that cluster The resulting ten band predetermined voicing vector 421 has ten voicing parameters 423 indicating the likelihood of each band being voiced or unvoiced. Then at step 474, the predetermined spectral vector 419 is stored at a location identified by an index. Next at step 476 the ten band predetermined voicing vector 421 is stored in the MBE voicing code book 416 at a location having the same index as the corresponding predetermined spectral vector 419. The common index identifies ten band predetermined voicing vector 421 and the spectral vector 419 representing the spectral and voicing characteristics of the cluster. Every segment of a very large number of segments of speech is analyzed in this manner. Once the MBE voicing code book 416 is determined, it is only used by the MBE synthesizer 116 in the receiver 114 and is not needed to be stored in the paging terminal 106. The ten band voicing analyzer 408 and the MBE voicing code book 416 is shown in FIG. 4 using dotted lines to illustrate that the ten band voicing analyzer 408 is only used during development of the spectral code book 418 and the MBE voicing code book 416.

Next at step 478, the residue vectors are calculated. The residue vectors are the differences between the spectral vectors 411 and the predetermined spectral vector 419 representing the associated cluster. Then at step 480, the residue vectors are clustered in the same manner as the spectral vectors 411 in step 466. At step 482, a centroid is calculated for each cluster and the vector defining the centroid becomes a predetermined residue vector. Then at step 484, each predetermined residue vector is stored as one vector of a set of predetermined residue vector comprising a residue code book 420. The residue code book 420 has a predetermined residue vector for each cluster derived.

The following formula is used to calculate the entropy of each band in each speech frame.

$$E_j = \log(S_j) - \frac{1}{S_j}\sum_{i=1}^{i=24} P_{i_j}^2 \log\left(P_{i_j}^2\right)$$

where:

$$S_j = \sum_{i=1}^{i=24} P_{i_j}^2$$

$P_{i_j}$ equals a FFT spectral element, j equals the harmonic band, i equals the harmonic within band j.

The RMS value of the frame energy is calculated by the energy calculator 410. The RMS frame energy is calculated by the following formula, $$\text{RMS} = \sqrt{\frac{\sum_{n=0}^{N} s^2(n)}{N}}$$

where:

s(n) equals the magnitude of the speech sample n and

N equals the number of speech samples in speech frame.

Figure 6:
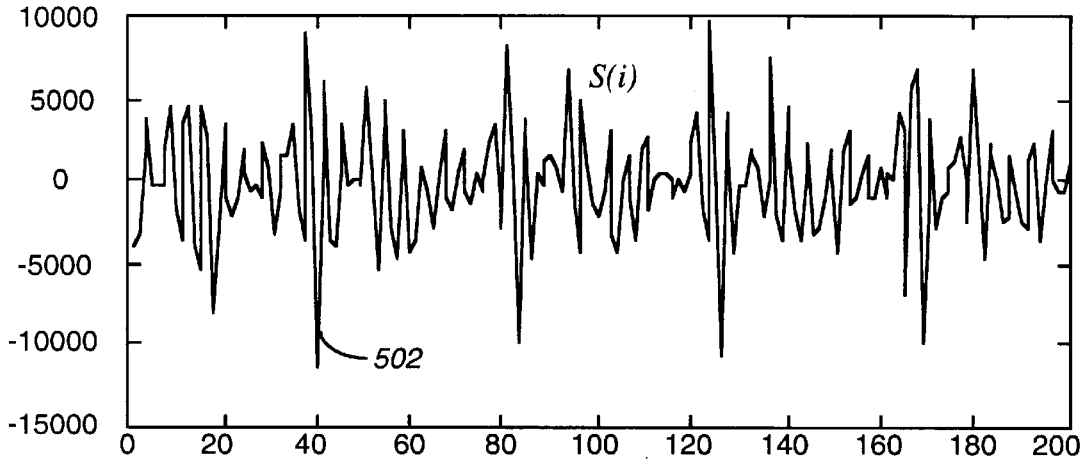
FIG. 6 shows a example of a segment of an analog speech wave form that when analyzed would be classified as voiced.

The pitch determiner 414 determines the pitch of the excitation source used by the MBE synthesizer 116 in the receiver 114. Pitch is defined herein as the number of speech samples between repetitive portions of speech. FIG. 6 shows an example of a portion of an analog speech wave form of a segment of speech 502. The portion of speech, in this example, is very repetitive and is classified as voiced. In the example, the distance between the repetitive portions is forty-three voice samples and the pitch is said to be 43. In the preferred embodiment of the present invention, the sampling rate is 8,000 samples per second, or 125 micro seconds (uS) per sample. Therefor, the time between peaks is 5.375 mili seconds (mS). The fundamental frequency of the analog speech wave form of a segment of speech 502 is the reciprocal of the period, or 186 Hz.

Figure 7:
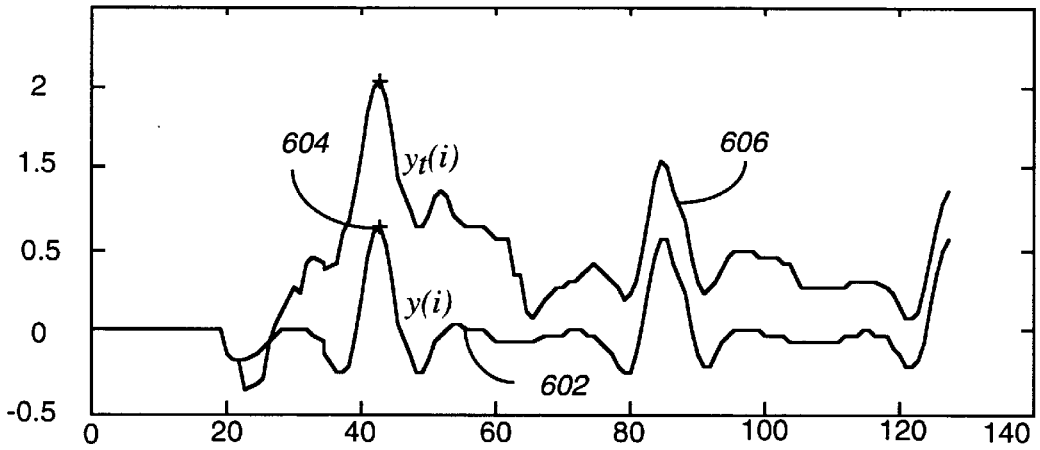
FIG. 7 is a plot of two pitch functions developed by communication system shown in FIG. 1 corresponding to the analog waveform shown in FIG. 6.

FIG. 7 is a plot of two pitch functions, y(i) 602 and $y_t$(i) 606, developed by the pitch determiner 414 corresponding to the analog speech waveform of a segment of speech 502 of FIG. 5. The human voice is very complex and an analysis of any portion will reveal the presence of many different frequency components. The plot of the function y(i) 602 shows the amplitude of the various components verses the pitch of those components. In this example, it is clear that there is a peak 604 at a pitch of 43. The determination and use of y(i) 602 and $y_t$(i) 606 will be described below.

Figure 8:
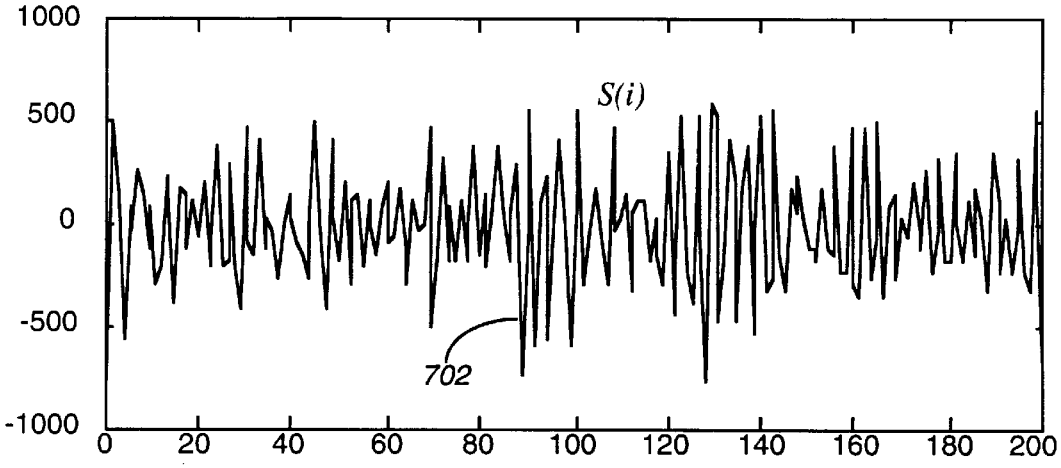
FIG. 8 shows a example of a portion of an analog speech wave form that when analyzed would be classified as unvoiced.
Figure 9:
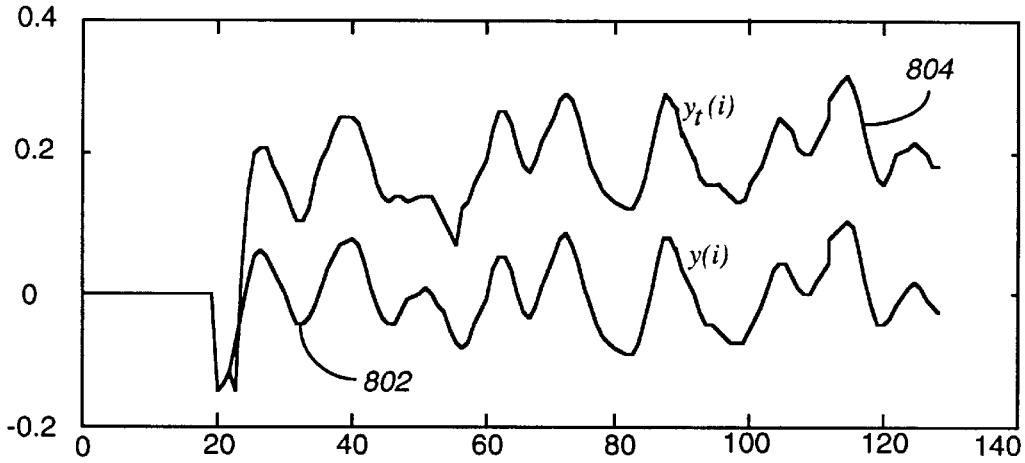
FIG. 9 is a plot of two pitch functions developed by communication system shown in FIG. 1 corresponding to the analog waveform shown in FIG. 8.

FIG. 8 shows a example of a portion of an analog waveform of a segment of speech 702. This portion of speech is very random and is classified as unvoiced. FIG. 9 is a plot of two pitch functions developed by the pitch determiner 414 corresponding to the analog waveform of a segment of speech 702 of FIG. 8. The plot of the function y(i) 802 shows the amplitude of the various components verses the pitch of those components. In this example there is no clear peak. The pitch determiner 414 examines the current frame and future frames to determine the correct pitch. The function $y_t$(i) 804 is developed by the pitch determiner 414 by utilizing information from current and future frames as will be described below.

Figure 10:
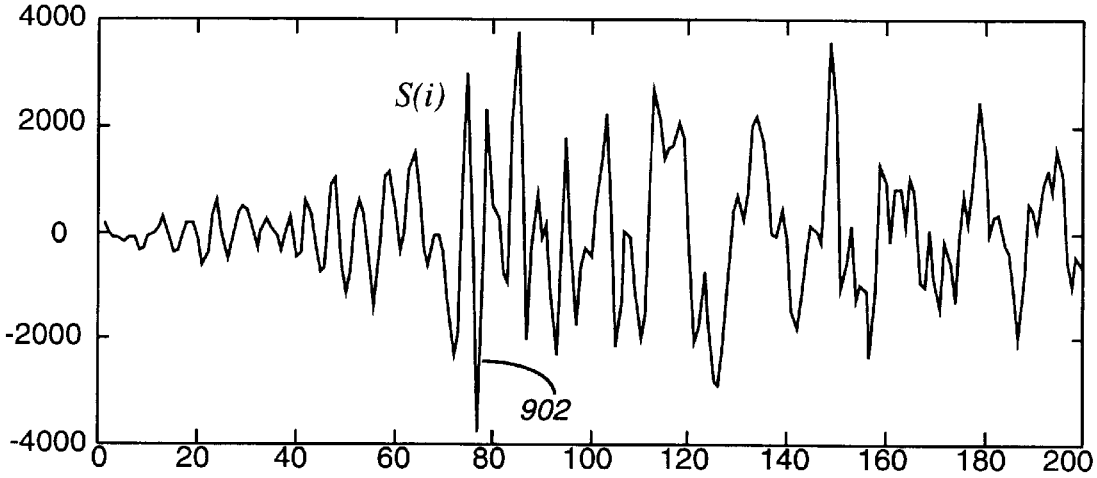
FIG. 10 shows a example of a portion of an analog speech wave form that when analyzed would be classified as transitional from unvoiced to voiced.
Figure 11:
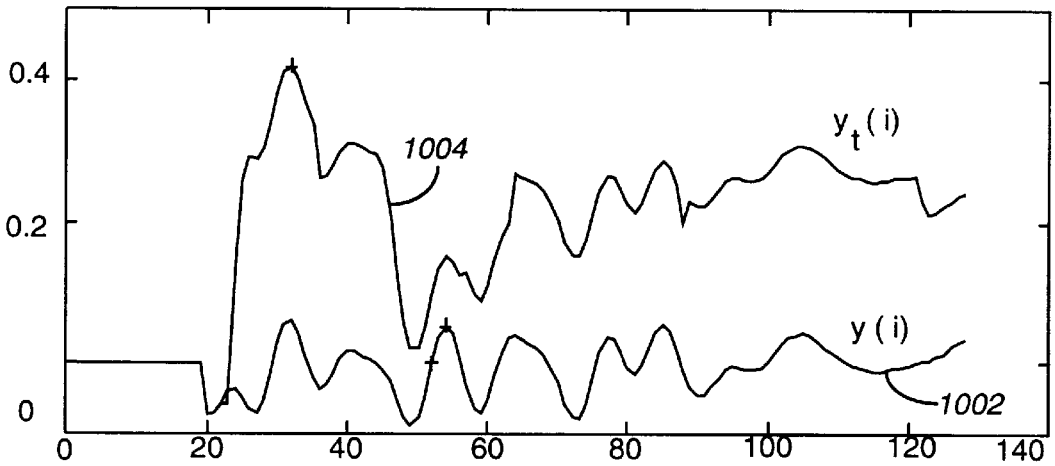
FIG. 11 is a plot of two pitch functions developed by communication system shown in FIG. 1 corresponding to the analog waveform shown in FIG. 10.

FIG. 10 shows an example of a portion of an analog waveform of a segment of speech 902. This portion starts very randomly and then develops a repetitive portion and is referred to as a transitional period of speech. FIG. 11 shows a plot of the function y(i) 1002 corresponding to the analog waveform of a segment of speech 902 of FIG. 10. The function y(i) 1002 does not have a clear peak. A plot of A function $y_t$(i) 1004 shows a more defined peak. The function $y_t$(i) is developed by the pitch determiner 414 by utilizing information from current and future frames as will be described below.

Figure 12:
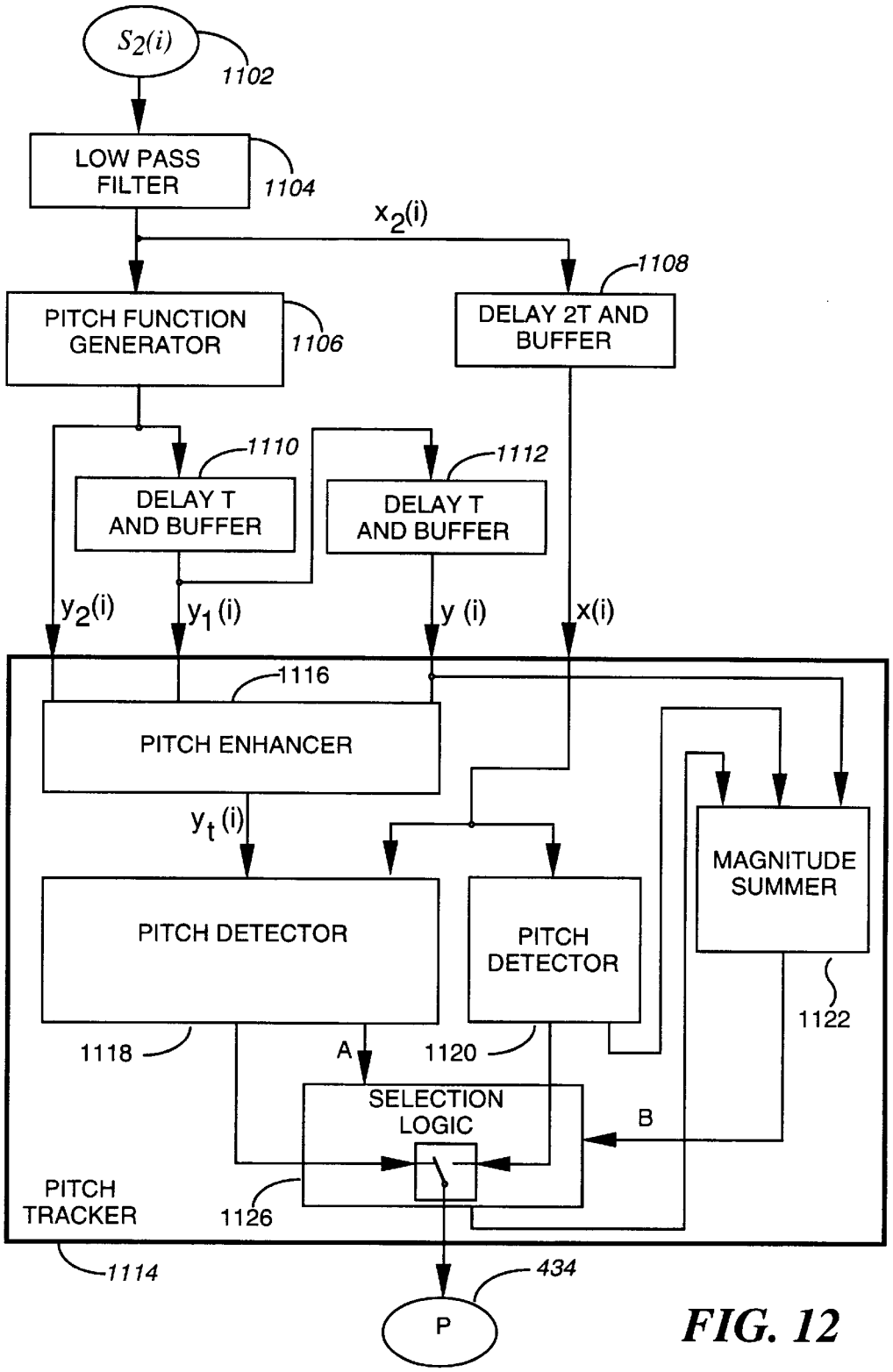
FIG. 12 is a block diagram representing an overview of the pitch determiner used in the speech analyzer shown in FIG. 4.

FIG. 12 is a block diagram representing an overview of the data flow for the pitch determiner 414. A frame of speech samples $S_2$(i) 1102 from the framer 404 is passed to a digital low pass filter 1104 for limiting the spectrum of the windowed speech samples to an anticipated range of pitch components. The low pass filter 1104 preferably has a cutoff frequency of 800 Hz. Low pass filtered speech samples, $x_2$(i), are fed to a pitch function generator 1106. The pitch function generator 1106 processes the low pass filtered speech samples to generate a pitch function $y_2$(i) that is an approximation of the amplitude of the pitch components verses the pitch.

The pitch function $y_2$(i) is fed to a one frame delay and buffer 1110 to generate the pitch function $y_1$(i). The pitch function $y_1$(i) then is fed to a one frame delay and buffer 1112 to generate the pitch function y(i). The time delays generated by the one frame delay and buffer 1110 and the one frame delay and buffer 1112 provides the pitch tracker 1114 with three frames of pitch information. The low pass filtered speech samples, $x_2$(i), from the low pass filter 1104 are also fed to a two frame delay buffer 1108 to generate a two frame delayed low pass filtered speech samples, x(i). The pitch function y(i) and the two frame delayed low pass filtered speech samples x(i) are referred to as the current frame. It is important for the understanding of this operation to keep in mind that the current frame has been delayed by two frames and that the pitch is not being determined in real time. The pitch function $y_1$(i) delayed one frame is referred to as being a first future frame and the pitch function $y_2$(i) is referred to as being two frames in the future or a second future frame. The definitions of the terms current frame, future frame and second future frame corresponds to the definition of the same terms used to describe S(i), $S_1$(i) and $S_2$(i) above in reference to FIG. 4.

The pitch tracker 1114 uses a pitch enhancer 1116 and a pitch detector 1118 to analyze the current frame pitch detection function, y(i), the two future frames of pitch functions, $y_1$(i) and $y_2$(i), and the current frame of the low pass filtered speech samples, x(i), to generate a first pitch candidate based on current and future frames. The pitch tracker 1114 also generates a second pitch candidate using a magnitude summer 1122 and a pitch detector 1120 and data from the current segment of speech and data from proceeding segments of speech. The selection logic 1126 acts as a candidate selector to choose the most viable pitch from a first pitch candidate and a second pitch candidate. A seven bit pitch data word 434 is generated by the pitch tracker 1114, and represents the measurement of the pitch of the current frame of speech. The seven bit pitch data word 434 is stored in the thirty-six bit transmit data buffer 424 for transmission.

Figure 13:
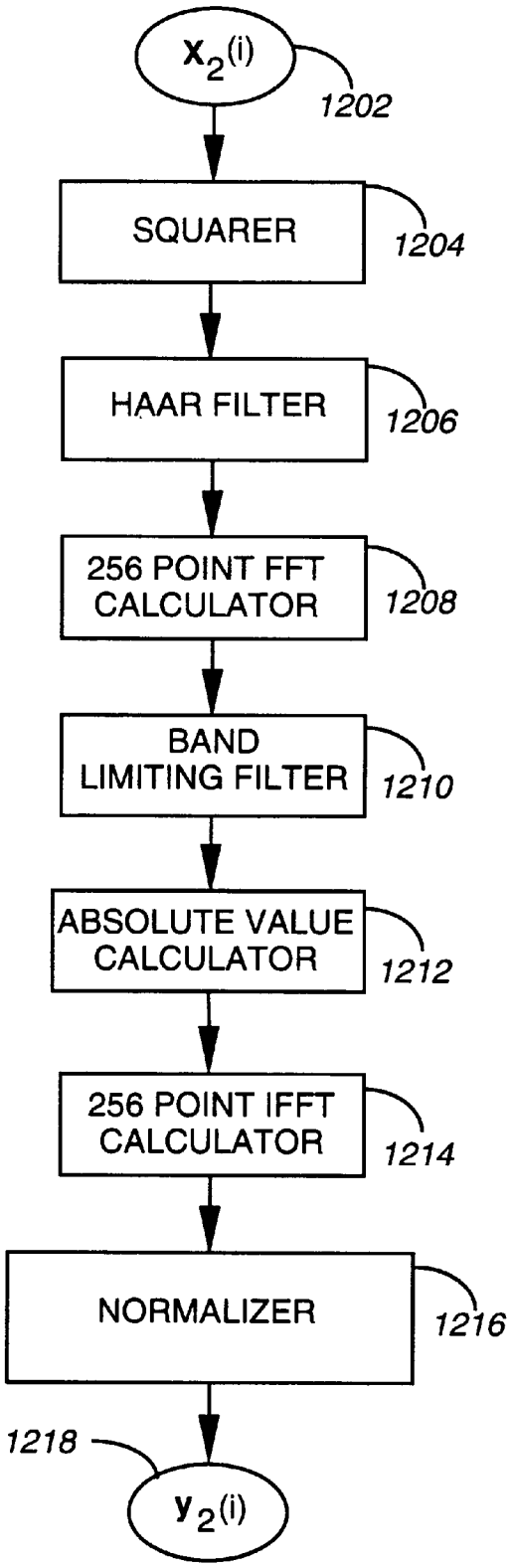
FIG. 13 is a flow chart showing details of the pitch function generator used in pitch determiner shown in FIG. 12.

FIG. 13 is a flow chart showing details of the pitch function generator 1106. The pitch function generator 1106 determines a function relating the magnitude of the spectral frequency components verses pitch for the frame of speech currently being processed. From this function an approximation of the pitch can be made. The magnitudes of the low pass filtered speech samples, $x_2$(i) 1202 are coupled to a squarer 1204 for generating squared digitized speech samples. The squaring is performed on a sample by sample basis. The squaring of $x_2$(i) 1202 produces a number of new frequency components. The new frequency components contain the sums and differences of the frequencies of the various components of the low pass filtered speech samples, $x_2$(i) 1202. The difference components of the harmonics of the fundamental pitch frequency will have components having frequency that are the same as the original pitch frequency. The regeneration of the fundamental pitch frequency is important because much of this portion of the speech spectrum is lost when the analog speech signal passes through the telephone network.

The squared samples are then preferably filtered using a Haar wavelet filter 1206. The Haar wavelet filter emphasizes the location of glottal events embedded in the original speech signal, increasing the accuracy of the pitch detection function. The Haar wavelet filter 1206 has a z transform transfer function as follows:

$$H(z) = \frac{1 - 2z^{-6} + z^{-12}}{1 - z^{-1}}$$

The Fast Fourier Transform (FFT) calculator 1208 performs a 256 point FFT on the filtered signal generated by the Haar wavelet filter 1206. The discrete FFT spectrum, $X_2$(k), generated by the FFT calculator 1208 has discrete components ranging from k equals −128 to +128. Because the Haar filtered signal $x_2$(i) 1202 is a real signal, the resulting FFT discrete spectrum is a symmetrical spectrum and all the spectral information is in either halve. The pitch function generator 1106 uses only the positive components. The resulting positive components are spectrally shaped by the spectral shaper 1210 to eliminate components outside the range of the anticipated pitch range. The spectral shaping 1210 sets the spectral components greater then k equals 47 to zero.

The absolute value of the discrete components produced by the spectral shaping 1210 is calculated by the absolute value calculator 1212. The absolute value calculator 1212 calculates the absolute value of the components of $X_2$(k) generating a zero phase spectrum.

An Inverse Fast Fourier Transform (IFFT) calculation is performed by the IFFT calculator 1214 on the absolute value of the spectrally shaped function $X_2$(k). The IFFT of the absolute value of the spectrally shaped function $X_2$(k) results in a time domain function resembling the time auto-correlation of the filtered $x_2$(i) 1202. The pitch detection function $y_2$(i) 1218 is produced by normalizing each pitch component produced by the IFFT calculator 1214 by the normalizer 1216. The normalizer 1216 normalizes the discrete component of the function produced by the IFFT calculator 1214 by dividing those components by the first or D.C. component of that function. A plot of y(i) 602 for a voiced portion of speech is shown in FIG. 7. In this example the peak 604 at a pitch of 43 is clearly identifiable.

Figure 14:
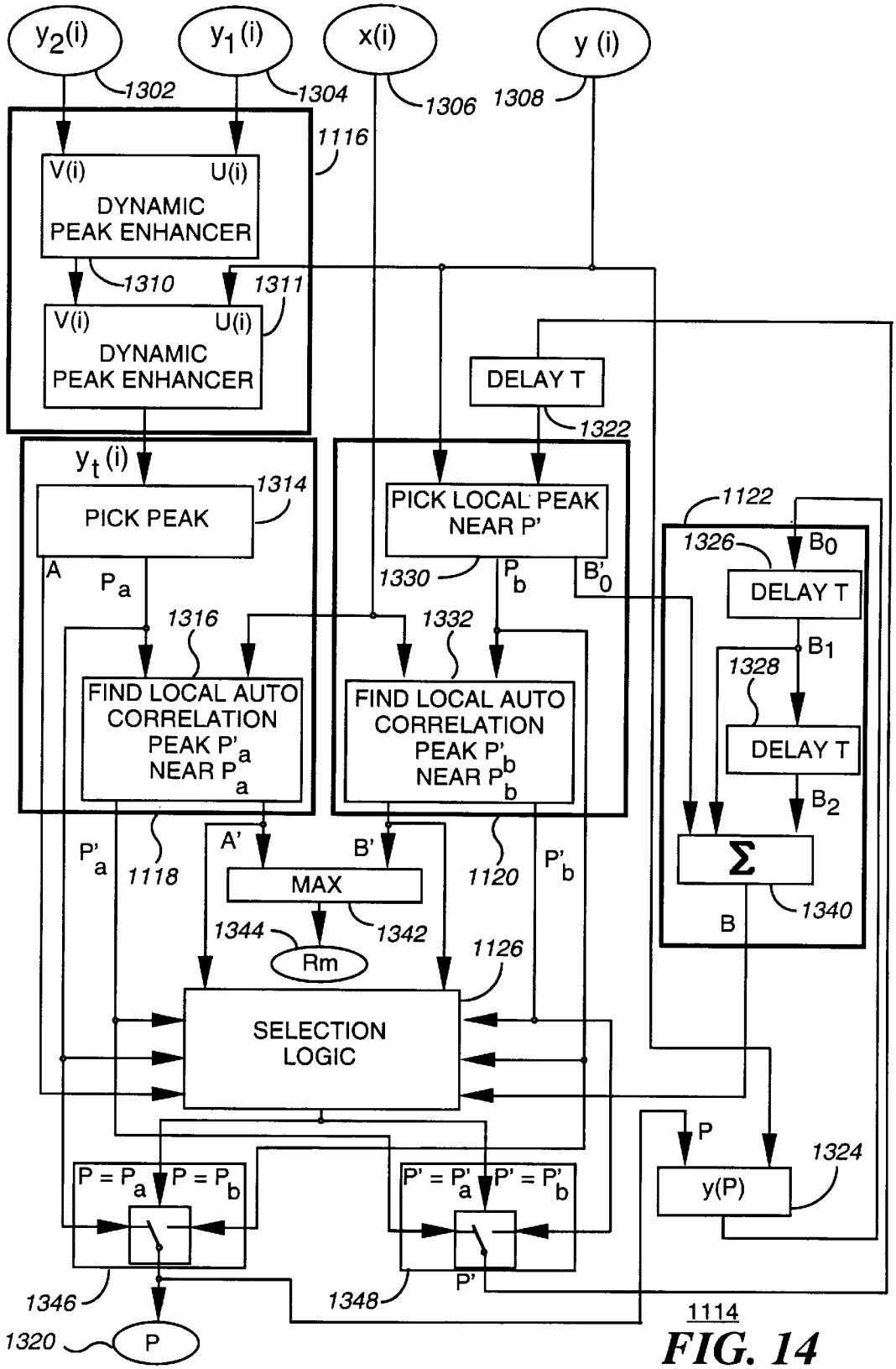
FIG. 14 is a block diagram detailing the operation of the pitch tracker used in the pitch determiner shown in FIG. 12.

FIG. 14 is a block diagram detailing the operation of the pitch tracker 1114. The pitch tracker 1114 produces two pitch values, P 1320 and P'. P 1320 is the pitch value determined for the current segment of speech and P' is a value used in the determination of the pitch value of future frames of speech. The pitch tracker 1114 uses the current frame pitch function y(i) 1308 and the pitch functions for the two future frames $y_1(i)$ 1304 and $y_2(i)$ 1302 to determine and track the pitch of the speech. The pitch tracker generates two possible pitch value candidates and then determines which of the two is the most probable value. The first candidate is a function of the current frame pitch function y(i) 1308 and the two future frames $y_1(i)$ 1304 and $y_2(i)$ 1302. The second candidate is a function of past pitch values and the current pitch function y(i). The second candidate is the most probable candidate during periods of slowly changing pitch, while the first candidate is the most probable during periods of speech where there is a sharp departure from the previous pitch.

A pitch enhancer 1116 comprises two dynamic peak enhancers 1310, 1311 for generating an enhanced pitch function comprising a plurality of enhanced pitch components. The dynamic peak enhancer 1310 uses the second future frame $y_2(i)$ 1302 coupled to a first input to enhance peaks in the future frame $y_1(i)$ 1304 coupled to a second input. The function generated is coupled to the first input of the second dynamic peak enhancer 1311 where it is used to enhance any peaks in the current frame pitch function y(i) 1304 coupled to a second input. Thus, the resulting function, $y_t(i)$, is the current frame pitch function enhanced by the pitch functions of both future frames. The value of this enhancement can be seen in the in FIG. 11. FIG. 11 is a plot of y(i) and yt(i) during a period of transition from unvoiced to voiced speech. While it is difficult to detect a clear peak in y(i) 1002, the peak in $y_t(i)$ 1004 is clear. The operation of the dynamic peak enhancer 1310 is explained below. In the preferred embodiment of the present invention, a pitch detection function from two future frames are used to enhance the peaks in the pitch detection function, y(i). However it will be appreciated that one or more future frames of pitch detection functions can be used as well.

A peak picking function 1314 searches the function $y_t(i)$ for a enhanced pitch component having a largest amplitude and returns the pitch value $P_a$ and the magnitude A at pitch value $P_a$. A localized auto-correlation function 1316 searches a limited range about pitch value $P_a$ for an auto-correlation peak. The auto-correlation function is a very computationally intensive process and by limiting the auto-correlation search to a range of about 30 percent of the range that would have to be searched using conventional methods results in a large savings of computational time. The localized auto-correlation function 1316 returns a pitch value $P'_a$ that is the location of the point of maximum auto-correlation in the vicinity of pitch value $P_a$. The pitch value $P_a$ is the first pitch value candidate of the current speech frame. The localized auto-correlation function 1316 also return A', the auto-correlation value calculated at pitch value $P'_a$. The operation of the localized auto-correlation function 1316 is described below.

A selection logic 1126, described below, determines a pitch value P 1320 and P'. The pitch value P' from the previous frame is used in the determination of the pitch in the next frame. The pitch value P' is buffered and saved for one frame by delay T 1322. The output of delay T 1322 becomes the pitch value P' from the previous frame. A peak picking function 1330 is coupled to y(i) and the pitch value P' from the previous frame. The peak picking function 1330 searches y(i) between i=0.85P' delayed and i=1.15P' delayed and returns a maximum magnitude, $B'_0$ and the value of i, pitch value $P_b$, at the maximum.

A localized auto-correlation function 1332 searches a limited range about pitch value $P_b$ for an auto-correlation peak. The localized auto-correlation function 1332 returns a pitch value $P'_b$ that is the location of the point of maximum auto-correlation in the vicinity of pitch value $P_b$. The pitch value $P'_b$ is the second pitch value candidate of the current speech frame. The localized auto-correlation function 1332 also returns B', the auto-correlation value calculated at pitch value $P'_b$. The operation of the localized auto-correlation function 1332 is described below.

A function y(P) 1324 returns a magnitude $B_0$ of the function y(i) at i equals pitch value P from the current frame. The magnitude $B_0$ is delayed one frame by delay T 1326 to become the magnitude $B_1$ of the previous frame. The magnitude $B_1$ is delayed one frame by delay T 1338 to become the magnitude, $B_2$, of the second previous frame. The magnitude $B_1$, the magnitude, $B_2$ and the magnitude $B'_0$ are summed by the summer 1340. The summer returns the result of the summation, B.

Pitch value $P_a$, pitch value $P'_a$, A and A' representing the first pitch value candidate, and pitch value $P_b$, pitch value $P'_b$, B and B' representing the second pitch value candidate are coupled to the selection logic 1126. The selection logic 1126 evaluates the inputs and determines the most likely pitch value P 1320. The selection logic 1126 then set a selector 1346 and a selector 1348 accordingly. Since the pitch range is from 20 to 128, in the preferred embodiment of the present invention, a value of one is subtracted from the pitch value resulting in a range of 19 to 127 so the pitch can be represented by seven bits. The seven bit pitch data word 434 from the pitch determiner 414 is a measurement of the pitch of the speech frame generated by the framer 404. The seven bit pitch data word 434 is stored in the thirty six bit transmit data buffer 424 for transmission. The operation of the decision logic 1318 is described below.

The value A' from the localized auto-correlation function 1316 and the value B' from the localized auto-correlation function 1332 are coupled to a max function detector 1342. The max function detector 1342 compares the value of A' and B' and returns the larger of the two as $R_m$ 1344. The use of the variable $R_m$ 1344 will be used below in reference to the description of the frame voiced/unvoiced parameter.

Figure 15:
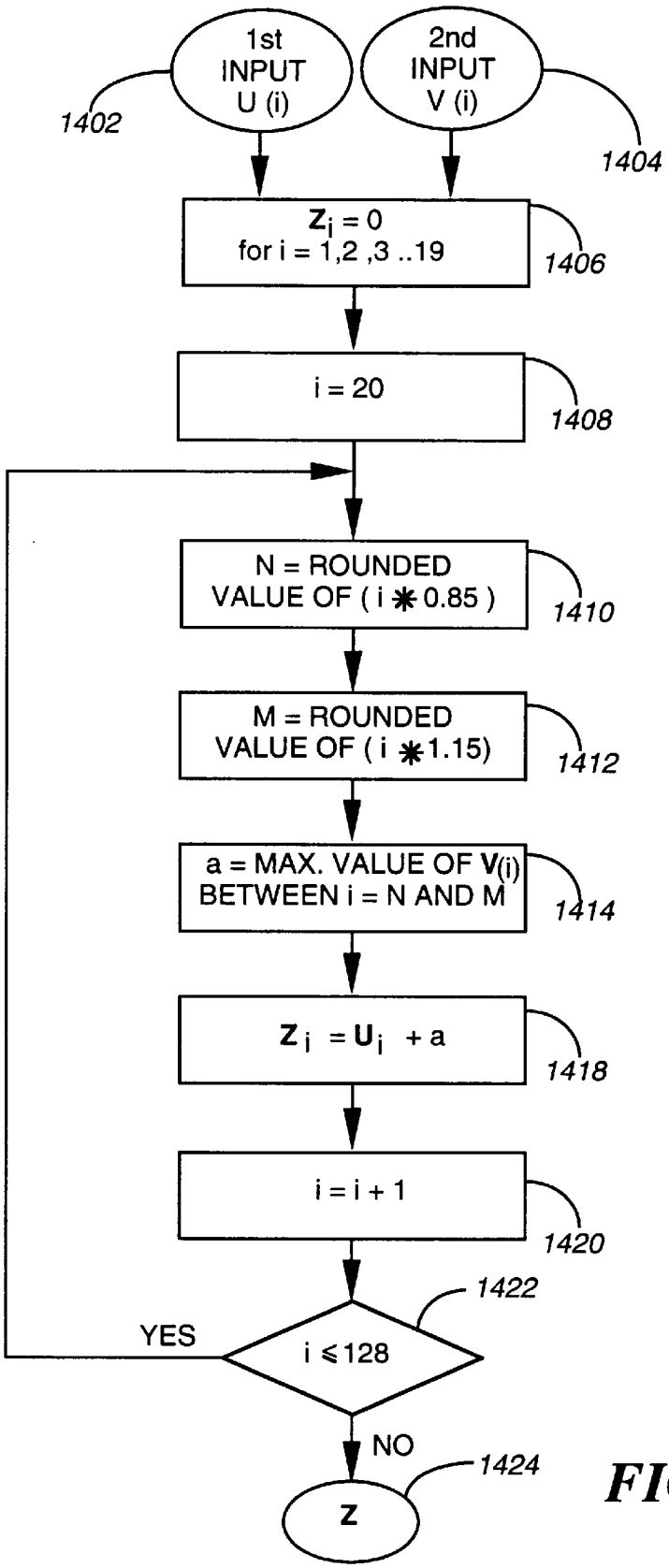
FIG. 15 is a flow chart showing the details the operation of the dynamic programming function used in the pitch detector tracker shown in FIG. 14.

FIG. 15 is a flow chart showing details of the operation of the dynamic peak enhancer 1310. The dynamic peak enhancer 1310 uses a function V(i) 1404 coupled to the second input 1404 to enhance peaks in function, U(i) coupled to a first input 1402. At step 1406 values of an output function Z(i) are set to zero from i equals 0 to i equals 19. Then at step 1408 the value of i is set to 20.

At step 1410 a first pitch component is selected and the value of the limit N is calculated. The pitch component has a magnitude of $S_i$. N is set equal to the greater of 1 or the value of 0.85 $S_i$ rounded down to the nearest integer value. Then at step 1412 the value of limit M is calculated. M is set equal to the lesser of 128 or the value of 1.15 $S_i$ rounded down to the nearest integer value. The value of N and M determine a range of pitch components. Next the first input 1402, V(i) is searched within the range determined for a second pitch component having a maximum amplitude.

At step 1418 the value output function z(i), where the each component in the output function is an enhanced pitch component, is calculated using the following formula.

$$z(i)=U(i)+a$$

At step 1420 the value of i is incremented by one. Then at step 1422 a test is made to determine if the value of i is equal to or less then 128. When at step 1422 the value of i is equal to or less then the predetermined number, 128, the process returns to step 1410 and step 1410 through step 1420 are repeated. When at step 1422 the value of i is greater then 128, the process is completed and at step 1424 the function Z(i) is returned.

Figure 16:
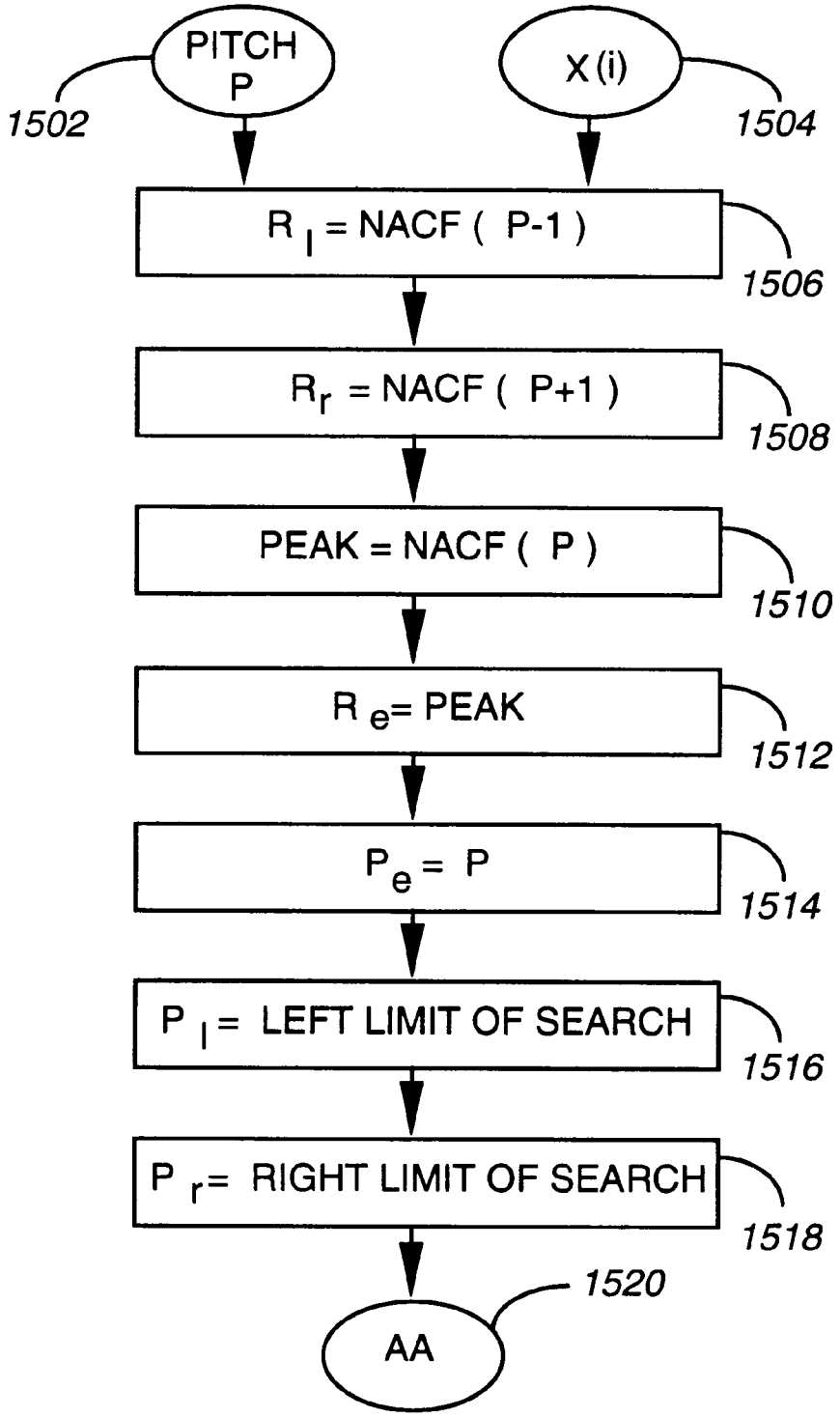
FIG. 16 is a flow chart showing a first portion of the localized auto-correlation function shown in FIG. 14.
Figure 17:
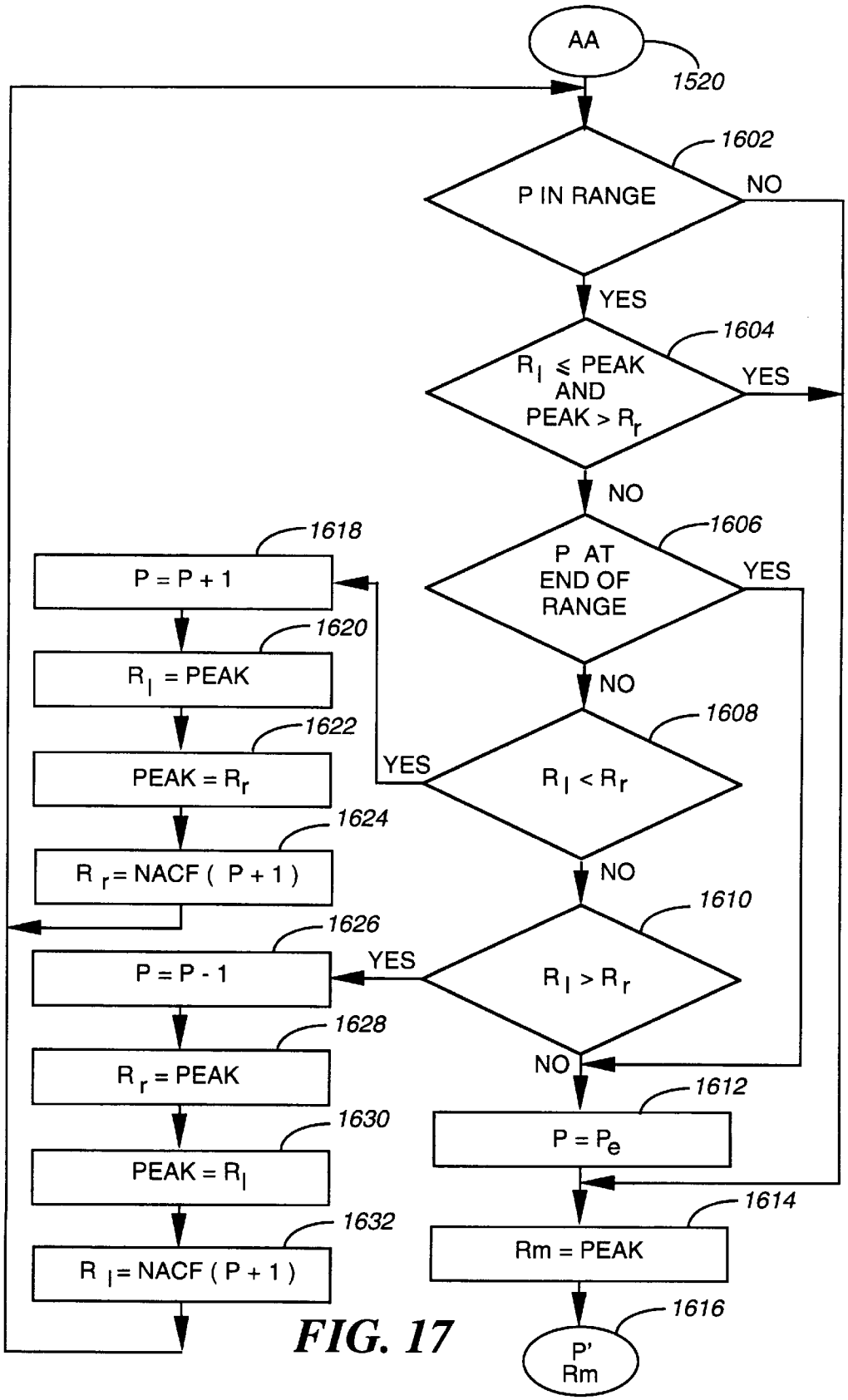
FIG. 17 is a flow chart showing a second portion of the localized auto-correlation function shown in FIG. 14.

FIG. 16 and FIG. 17 are flow charts showing the details of the localized auto-correlation function 1316 and the localized auto-correlation function 1332. FIG. 16 shows the initialization process performed before the main loop shown in FIG. 17 is performed. The correlation is a metric used to measure the similarity between two segments of speech. The correlation will be at a maximum value when the offset between the two segments is equal to the pitch. As stated above, the pitch is defined as the distance between the repetitive portions of speech. The distance is measured as the number of samples between the repetitive portions. The localized auto-correlation function 1332 reduces computation by limiting the search for the maximum auto-correlation of the pitch function, x(i), received on the second input 1504, to the vicinity of the input 1502, P. The function is designed to minimize the number of calculations by observing the correlation results and intelligently determining the direction that the maximum auto-correlation will occur. The correlation function used in the preferred embodiment of the present invention uses the following normalized auto-correlation function (NACF).

$$NACF(1)=\frac{\sum_{n=129}^{129+1}(x(n))(x(n-1))}{\sqrt{\left(\sum_{n=129}^{129+1}x^2(n)\right)\left(\sum_{n=129}^{129+1}x^2(n-1)\right)}}$$

Where;

equals the offset, and x(n) equals the low pass filtered delayed speech samples x(i) 1306, when n=i.

Referring to FIG. 16, the pitch value, P, is received on the first input 1502 and the pitch function, x(i) is received on the second input 1504. At step 1506 the NACF is calculated for 1=P−1. The result is stored as a temporary variable, result right ($R_r$). Next at step 1508 the NACF is calculated for 1=P+1. The result is stored as a temporary variable, result left ($R_l$). Then at step 1510 the NACF is calculated for 1=P. The result is stored as a temporary variable PEAK. Then at step 1512 a copy of the temporary variable PEAK is saved in temporary variable $R_e$. Then at step 1512 a copy of the temporary variable P is saved in temporary variable $P_e$.

Next at step 1516, the left or lower limit ($P_l$) of the search is determined. $P_l$ is set equal to 0.85P rounded down to the nearest integer. Then at step 1518 the right or upper limit ($P_u$) of the search is determined. $P_u$ is set equal to 1.15P rounded down to the nearest integer. The initialization process is completed at point AA 1520.

FIG. 17 shows the main loop of the localize auto-correlation calculation. The process continues from point AA 1520. At step 1602 a test is made to determine if pitch value P is within the search range limits. The lower range limit is defined as the greater of the lower limit, $P_l$ and the absolute lower limit 20. The upper limit is defined as the lesser of the upper limit, $P_u$ and the absolute upper limit of 128. When the value of pitch value P is not within this range, the localized auto-correlation calculation has been completed and the process goes to step 1614. When the value of P is within this range, the process continues at step 1604.

At step 1604 a test is made to determine when the auto-correlation result to the right and to the left of pitch value P are less then the result at pitch value P indicating that pitch value P is already at the peak. The test compares the correlation result, PEAK with $R_l$ and $R_r$. When PEAK is greater then $R_r$ and PEAK is greater then or equal to $R_l$ then pitch value P is determined to be at the point of maximum correlation and the process goes to step 1614. When PEAK is less then $R_r$ and $R_l$ then pitch value P is not at the point of maximum correlation and the process continues at step 1606.

At step 1606 a test is made to determine if pitch value P is at the end of the search range limits. When pitch value P is equal to the lower range limit, that P is equal to the greater of the lower limit, $P_l$ plus one and the absolute lower limit 20 plus one P is at the end of range and the process goes to step 1612. When P is not at the end of range the process continues at step 1608.

At step 1608 a test is made to determine when the search should move to the left. When the value of $R_r$ is greater than $R_l$ the process should move to the right and the process goes to step 1618. When the value of $R_r$ is not greater than $R_l$ then at step 1610, a test is made to determine if the search should move to the left. When the value of $R_l$ is greater than $R_r$ then the process goes to step 1626. When the value of $R_l$ is not greater than $R_r$ the process continues at step 1612.

Step 1612 is performed when step 1602 through step 1610 indicates that the initial values determined at point AA 1520 represents the best correlation. Then at step 1612 the value of P is set to the value of $P_e$. Next at step 1614 $R_m$ is set equal to PEAK. Next at step 1616 the process is completed and the values of P and $R_m$ are returned.

At step 1618, when it is determined at step 1608 that the process should move to the right, the pitch value P is incremented by one. Next at step 1620 the value of $R_l$ is set equal to PEAK and at step 1622 PEAK is set equal to $R_r$. Then at step 1624 a new value is calculated for $R_r$ using the following formula.

$$R_r=NACF(P+1)$$

After step 1624 the process goes to step 1602 described above.

At step 1626, when it has been determined at step 1610 that the process should move to the left, the pitch value P is decrement by one. Next at step 1628 the value of $R_r$ is set equal to PEAK and at step 1630 PEAK is set equal to $R_l$. Then at step 1632 a new value is calculated for $R_l$ using the following formula.

$$R_l=NACF(P-1)$$

After step 1632 the process goes to step 1602 described above.

Figure 18:
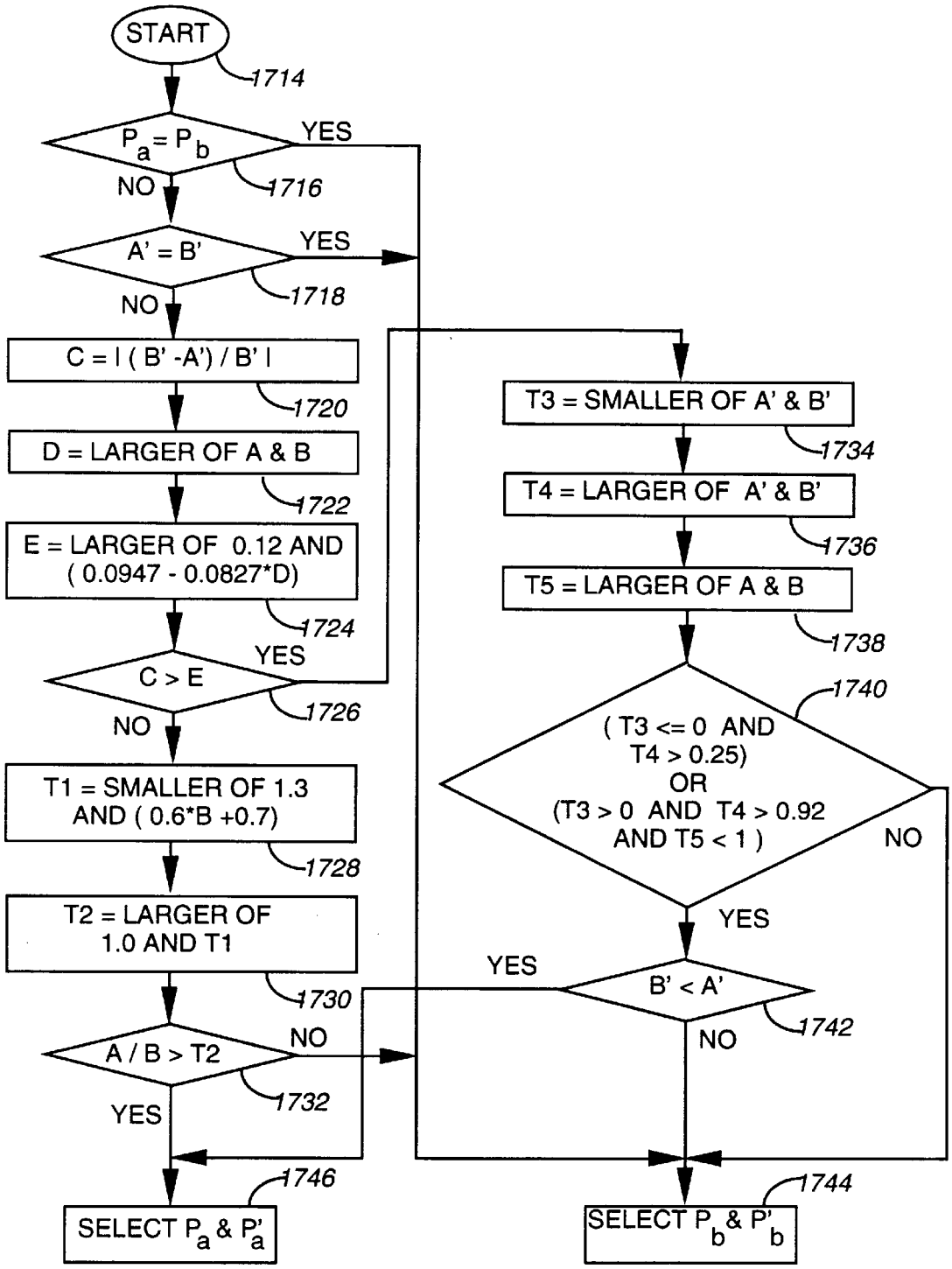
FIG. 18 is a flow chart showing the selection logic used to determine the pitch candidate of the two pitch candidates shown in FIG. 14 that most accurately characterizes the pitch of a speech Segment.

FIG. 18 is a flow chart of the selection logic 1126 used to determine whether the first pitch candidate $P_a$ or the second pitch candidate $P_b$ most accurately characterizes the pitch of the speech segment. The selection logic 1126 receives the following:

the pitch candidate $P_a$, the magnitude A, of the pitch function $y_t(i)$ at $P_a$, the point of maximum correlation of the localized auto-correlation function 1316, $P'_a$, the correlation value A' at $P'_a$, the pitch candidate $P_b$, the magnitude B, of the pitch function y(i) 1308 at $P_b$, the point of maximum correlation of the localized auto-correlation function 1332, $P'_b$, and the correlation value B' at $P'_b$.

The selection logic 1126 starts at step 1714. At step 1716, the values of $P_a$ and $P_b$ are compared. When at step 1716 the values of $P_a$ and $P_b$ are equal then at step 1744 values of $P_b$ and $P'_b$ are selected for P and P' respectively and the selection process is completed. When at step 1716 the values of $P_a$ and $P_b$ are not equal, then at step 1718 the value of A' and B' are compared. When at step 1718 the value of A' and B' are essentially equal, then at step 1744 values of $P_b$ and $P'_b$ are selected for P and P' respectively and the selection process is completed. When at step 1718 the value of A' and B' are not essentially equal, then at step 1720 the value of the variable C is calculate using the following formula.

$$C = \left|\frac{(B' - A')}{B'}\right|$$

Next step 7122 the value of a variable D is set equal to the larger of A and B. Then at step 1724 the value of the variable E is set equal to the larger of 0.12 and the quantity (0.0947–0.0827*D). Then at step 1726 the value of C is compared with the value of E. When at step 1726 value of C is not greater then the value of E, the process continues at step 1728. At step 1728 the value of variable T1 is set equal to the smaller of the 1.3 and the quantity (0.6*B+0.7). Next at step 1730 the variable T2 is set equal to the larger of 1.0 and T1. Then at step 1732 the quantity A/B is compared to the value of T2. When at step 1732 the quantity A/B is greater then the value of T2, then at step 1746 the values of $P_a$ and $P'_a$ are selected for P and P', respectively, and the selection process is completed. When at step 1732 the quantity A/B is not greater then the value of T2, then at step 1744 the values of $P_b$ and $P'_b$ are selected for P and P', respectively, and the selection process is completed.

When at step 1726 value of C is greater then the value of E, the selection process continues at step 1734 where the value of a variable T3 is set equal to the smaller of A' and B'. Next at step 1736 a variable T4 is set equal to the larger of A' and B', and at step 1738 the value of a variable T5 is set equal to the larger of A and B. Then at step 1740 a test is made to determine if either of the following two conditions are true. The first condition is, T3 is equal to or less then 0.0 and T4 is greater then 0.25. The second condition is, T3 is greater then 0.0 and T4 is greater then 0.92 and T5 is less then 1.0. When neither of the conditions are true at step 1740, the process continues at step 1744 where the values of $P_b$ and $P'_b$ are selected for P and P', respectively, and the selection process is completed. When either of the conditions are true at step 1740, the process continues at step 1742 where the value of B' is compared with the value of A'. When at step 1742 where the value of B' is less then the value of A', then at step 1746 the values of $P_a$ and $P'_a$ are selected for P and P' respectively, and the selection process is completed. When at step 1742 where the value of B' is not less then the value of A', then at step 1744 the values of $P_b$ and $P'_b$ are selected for P and P', respectively, and the selection process is completed.

Figure 19:
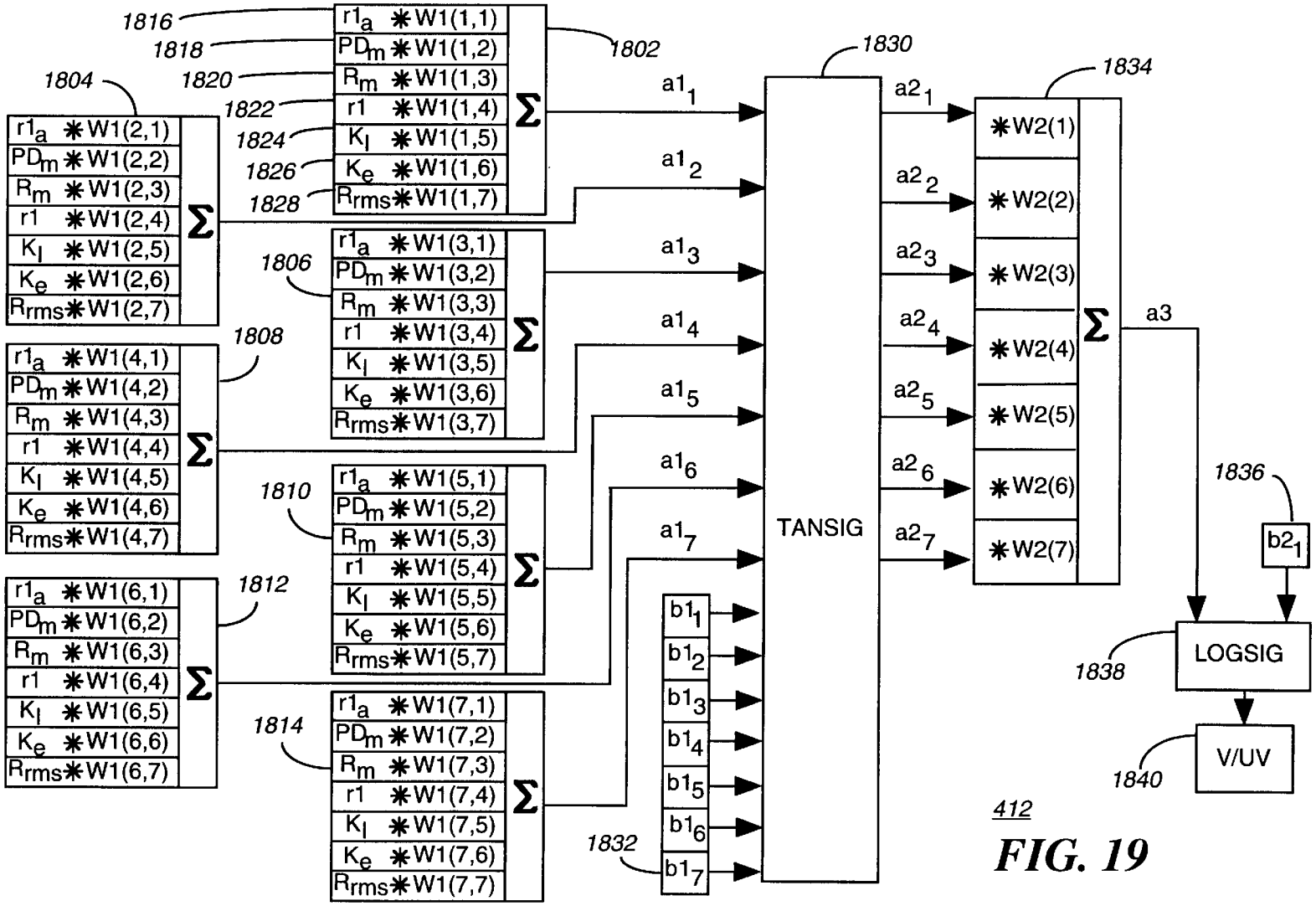
FIG. 19 is a block diagram showing the operation of the frame voicing classifier shown in FIG. 4.

FIG. 19 shows the frame voicing classifier 412. The frame voicing classifier 412 derives seven parameters from the current speech frames digitized speech samples. The parameters are $r1_a$, $PD_m$, $R_m$, r1, $K_l$, $K_e$, and $R_{rms}$.

The parameter r1 is the result of a normalized one sample delayed auto-correlation calculation. r1 is calculated by the following formula, $$r1 = \frac{N\sum_{n=2}^{N} s(n)s(n-1)}{(N-1)\sum_{n=1}^{N} s^2(n)}$$

Where;

s(n) equals S(i), i=n and

N equals the parameters in the function s(n).

The parameter $r1_a$ is the result of an empirically determined formula. The calculation of the parameter is similar to r1 with the exception of the absolute value of s(n)s(n−1) being used in the numerator and the −0.5 offset.

$r1_a$ is calculated by the following formula, $$r1_a = \frac{N\sum_{n=2}^{N} |s(n)s(n-1)|}{(N-1)\sum_{n=1}^{N} s^2(n)} - 0.5$$

$PD_m$ is a peak value of the function y(i), between the pitch range of 20 to 128. The function y(i) is described above in reference to the description of the pitch determiner 414.

$R_m$ 1344 is the larger of value of the localized auto-correlation function 1316 at $P'_a$ and the value of the localized auto-correlation function 1332 at P'b. $R_m$ 1344 is described above in reference to the description of the pitch tracker 1114.

$K_l$ is a ratio of a low band energy to the full band energy $K_l$ is calculated by the following formula, $$K_1 = \frac{\sum_{n=1}^{N} s_1^2(n)}{\sum_{n=1}^{N} s^2(n)}$$

Where;

$s_l(n)$ equals lowpass filtered delayed speech samples, x(i) 1306 and s(n) equals the current frame speech samples S(i).

$K_e$ is value of the calculated normalized energy around the peak point of energy in the current speech frame.

$K_e$ is calculated by the following formula, $$K_e = \frac{N\sum_{n=n_m-d}^{n_m+d} s^2(n)}{(2d+1)\sum_{n=1}^{N} s^2(n)}$$

Where:

d equals 4 and $n_m$ equals the value of i at the maximum value of S(i) for the current frame.

$R_{rms}$ is calculated by the following formula, $$R_{\text{rms}} = \log\left(\frac{\text{RMS}}{\text{RMS}_{\max}}\right)$$

Where:

$RMS_{max}$ equals the RMS value of the largest 1024 sample segments of the speech message. The speech message is divided into 1024 sample segments and the RMS value is calculated using the RMS formula above. The RMS value of the Segment having the largest RMS value is selected and used for $RMS_{max}$.

The frame voicing classifier 412 arranges the seven input parameters into a input vector P.

$$P = \begin{bmatrix} rl_a \\ PD_m \\ R_m \\ rl \\ K_1 \\ K_e \\ R_{\text{rms}} \end{bmatrix}$$

An empirically determined matrix W1 is multiplied by the input vector P using matrix multiplication. The method of determining the coefficients of the weighting matrix W1 is described below. The result of the multiplication produces an intermediate vector a1 having seven coefficients, $a1_1$ through $a1_7$.

$$W1 = \begin{bmatrix} (1,1) & (1,2) & (1,3) & (1,4) & (1,5) & (1,6) & (1,7) \\ (2,1) & (2,2) & (2,3) & (2,4) & (2,5) & (2,6) & (2,7) \\ (3,1) & (3,2) & (3,3) & (3,4) & (3,5) & (3,6) & (3,7) \\ (4,1) & (4,2) & (4,3) & (4,4) & (4,5) & (4,6) & (4,7) \\ (5,1) & (5,2) & (5,3) & (5,4) & (5,5) & (5,6) & (5,7) \\ (6,1) & (6,2) & (6,3) & (6,4) & (6,5) & (6,6) & (6,7) \\ (7,1) & (7,2) & (7,3) & (7,4) & (7,5) & (7,6) & (7,7) \end{bmatrix}$$

Matrix multiplication is a systematic procedure readily handled by a digital signal processor. The calculation 1802 of the first coefficient $a1_1$ involves calculating the summation of the following:

The product of the multiplication 1816 of the first coefficients of the first row of W1 by the first coefficient of the first column of P.

The products of the multiplication's 1818–1828 of the second through seventh coefficients of the first row of W1 by the second through seventh coefficients of the first column of P, respectively.

The calculations 1804–1814 of the second through seventh coefficients, $a1_2$ through $a1_7$ are performed in a similar manner using the second through seventh rows of W1, respectively and the first column of P.

The coefficients of the intermediate vector a1 and the coefficients of an empirically determined vector b1 1832 which is processed using a tansig function to generate a second intermediate vector a2. The tansig function 1830 is a non-linear function, defined as $$a2_n = \text{tansig}(a1_n, b1_n)$$

where, $$\text{tansig}(a1_n, b1_n) = \frac{2}{1 + e^{(-2(a1_n + b1_n))}}$$

The intermediate vector a2 is multiplied by an empirically determined matrix W2 to generate a single cell vector a3.

$$W2 = [(1)(2)(3)(4)(5)(6)(7)]$$

The vector multiplication 1834 of the intermediate vector a2 and the matrix W2 involves calculating the summation of the following The product of the first coefficients of the first row of W2 by the first coefficient of the first column of a2.

The product of the second through seventh coefficients of the first row of W2 by the second through seventh coefficients of the first column of a2, respectively.

The coefficient of the vector a3 and the coefficient of a second empirically determined vector b2 1836 is processed by a logsig function 1838 to generate $V_f$. The logsig function 1838 is a non-linear function, defined as $$V_f = \text{logsig}(a3_1, b2_1)$$

where, $$\text{logsig}(a3_n, b2_n) = \frac{1}{1 + e^{(-(a3_1 + b2_1))}}$$

The voiced/unvoiced comparator 1840 compares the value of $V_f$ with 0.5. When the value of $V_f$ is greater than 0.5, the frame is classified as voiced and when the value of $V_f$ is less then 0.5, the frame is classified as unvoiced. When the frame is classified as voiced the V/UV bit is set to 1, otherwise it is set to 0.

The determination of the coefficients of W1, W2, b1, and b2 is an empirical training process involving several steps. A very large number of speech segments are manually analyzed by observing their waveform by one skilled in the art and making a judgment as to their voicing characteristics. The voicing characteristics of the speech segments are then determined by the frame voicing classifier 412 as various coefficients for W1, W2, b1, and b2 are tried. The performance of the frame voicing classifier 412 is determined by comparing the classifier's results with the manually determined results. With the aide of a computer, the coefficients for W1, W2, b1, and b2 are varied until desired accuracy is obtained.

Figure 20:
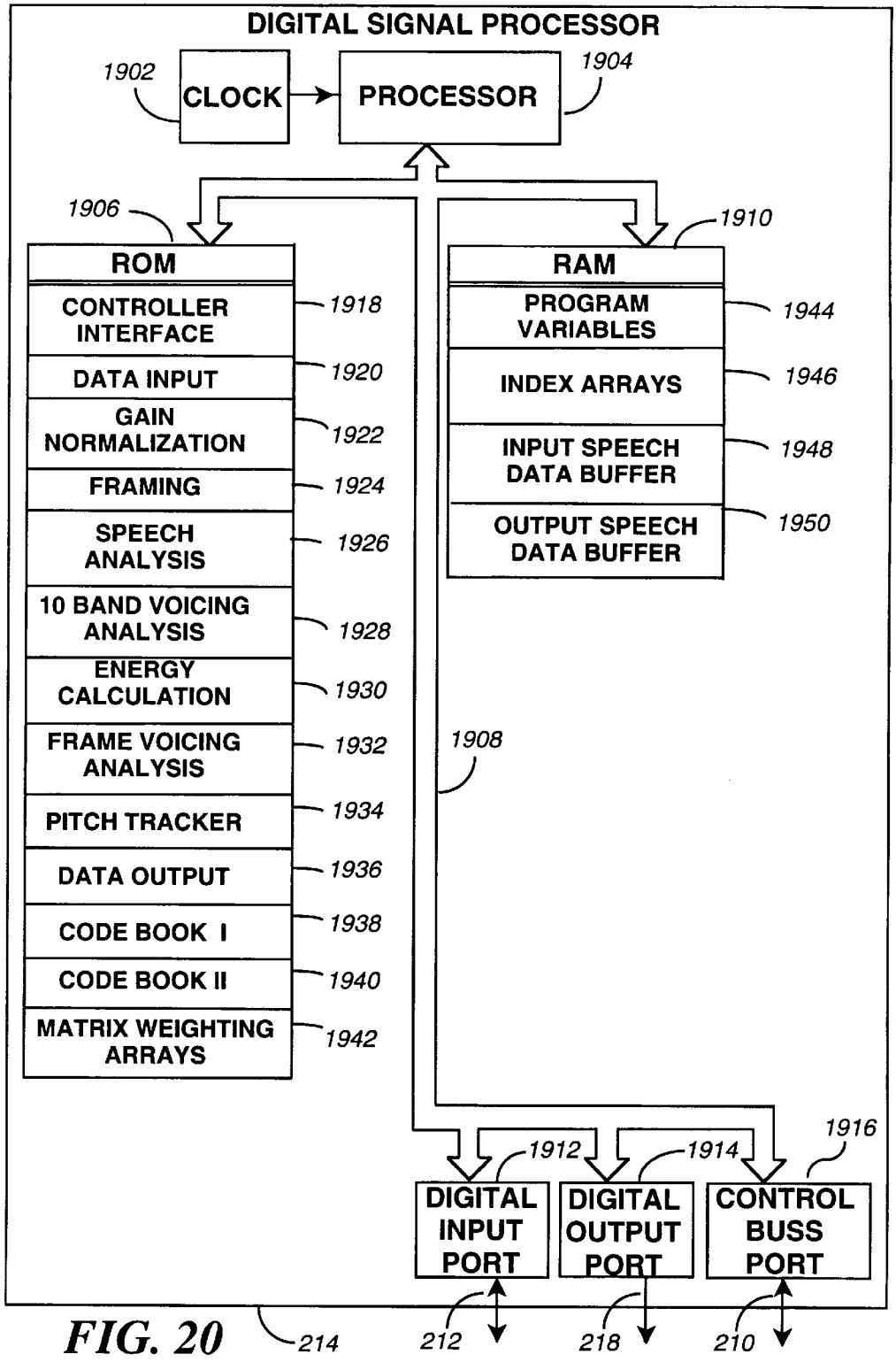
FIG. 20 shows an electrical block diagram of the digital signal processor utilized in the paging terminal shown in FIG. 2

FIG. 20 shows an electrical block diagram of the digital signal processor 214 utilized in the paging terminal 106 shown in FIG. 2 to perform the function of the speech analyzer 107. A processor 1904, such as one of several standard commercial available digital signal processor ICs specifically designed to perform the computations associated with digital signal processing, is utilized. Digital signal processor ICs are available from several different manufactures, such as a DSP56100 manufactured by Motorola Inc. of Schaumburg, Ill. The processor 1904 is coupled to a ROM 1906, a RAM 1910, a digital input port 1912, a digital output port 1914, and a control bus port 1916, via the processor address and data bus 1908. The ROM 1906 stores the instructions used by the processor 704 to perform the signal processing function required for the type of messaging being used and control interface with the controller 216. The ROM 1906 also contains the instructions used to perform the functions associated with compressed voice messaging. The RAM 1910 provides temporary storage of data and program variables, the index arrays, the input voice data buffer, and the output voice data buffer. The digital input port 1912 provides the interface between the processor 1904 and the input time division multiplexed highway 212 under control of a data input function and a data output function. The digital output port provides an interface between processor 1904 and the output time division multiplexed highway 218 under control of the data output function. The control bus port 1916 provides an interface between the processor 1904 and the digital control bus 210. A clock 1902 generates a timing signal for the processor 1904.

The ROM 1906 contains by way of example the following: a controller interface function routine 1918, a data input function routine 1920, a gain normalization function routine 1922, a processing routine for the framer 404, a processing routine for the LPC analyzer 406, a processing routine for the ten band voicing analyzer 408, a processing routine for the energy calculator 410, a processing routine for the frame voicing classifier 412, a processing routine for the pitch determiner 414, a data output function routine 1936, one or more spectral code books 418, one or more residue code books 420, and one or more matrix weighting arrays 1942 as described above. RAM 1910 provides temporary storage for program variables 1944, index array 431, an input speech data buffer 1948 and an output speech buffer 1950. It will be appreciated that elements of the ROM 1906, such as the code book, can be stored in a separate mass storage medium, such as a hard disk drive or other similar storage devices.

In summary, speech sampled at a 8 KHz rate and encoded using conventional telephone techniques requires a data rate of 64 Kilo bits per second. However, speech encoded in accordance with the present requires a substantially slower transmission rate. For example, speech sampled at a 8 KHz rate and grouped into frames, or speech segments, representing 25 milliseconds of speech can be transmitted at an average data rate of 1,440 bits per second in accordance with the present invention. As hitherto stated, the speech analyzer of the present invention digitally encodes the voice messages in such a way that the resulting data is very highly compressed and can easily be mixed with conventional paging data sent over a paging channel. The following functions are provided that greatly improve the operation and reduces the data rate: a highly accurate FFT based pitch determination and tracking function that can determine and track pitch even when the fundamental pitch frequencies are severely attenuated and reduces the computational intensity of the compression process; a highly accurate non-linear frame voicing determination function; a method of providing multi-band voicing information not requiring the transmission of multi-band voicing information; and a natural sounding artificially generated excitation phase not requiring the transmission of phase information. In addition, the voice message is digitally encoded in such a way, that processing within the pager, or similar portable communication device is minimized. While specific embodiment of this invention have been shown and described, it can be appreciated that further modification and improvement will occur to those skilled in the art.

We claim:

1. A pitch determiner for use with a speech analyzer for determining a pitch within one or more sequential segments of speech, each segment of speech being represented by a predetermined number of digitized speech samples, said pitch determiner comprising:

a pitch function generator for generating from the predetermined number of digitized speech samples, a plurality of pitch components representing a pitch function, wherein said pitch function defines an amplitude of each of the plurality of pitch components;

a pitch enhancer, for enhancing the pitch function of a current segment of speech utilizing the pitch function of one or more sequential segments of speech, by generating a plurality of enhanced pitch components; and a pitch detector for detecting the pitch of the current segment of speech by determining the pitch of an enhanced pitch component having a largest amplitude of the plurality of enhanced pitch components.

2. The pitch determiner of claim 1, further comprising a digital filter, coupled to an input of said pitch function generator, for limiting a spectrum of the segment of speech to an anticipated range of pitch components.

3. The pitch determiner of claim 1, further comprising one or more delay elements for generating the pitch function of one or more sequential segments of speech.

4. The pitch determiner of claim 1, wherein said pitch function generator comprises:

a squarer for squaring each of the predetermined number of digitized speech samples representing a segment of speech to generating squared digitized speech samples;

Fast Fourier Transform (FFT) calculator for deriving frequency components corresponding to the predetermined number of squared digitized speech samples representing a segment of speech;

an absolute value calculator for calculating an absolute value of the frequency components derived by tb FFT calculator; and an Inverse Fourier Transform (IFFT) calculator for deriving a plurality of pitch components from the frequency components derived by the FFT calculator.

5. The pitch determiner according to claim 4, further comprising a haar filter, coupled to said squarer and to said FFT calculator, for emphasizing glottal events embedded in the speech thereby increasing accuracy of pitch detection.

6. The pitch determiner according to claim 4, further comprising a band limiting filter, coupled to said FFT calculator and to said absolute value calculator, for limiting the range of the frequency components derived by the FFT.

7. The pitch determiner according to claim 4, further comprising a normalizer, coupled to said IFFT calculator for normalizing each pitch component of said plurality of pitch components derived therefrom.

8. The pitch determiner according to claim 1, wherein said pitch enhancer comprises a dynamic peak enhancer for generating a plurality of enhanced pitch components from a plurality of pitch components, said dynamic peak enhancer being programmed to perform the steps of:

(a) selecting a first pitch component of a first pitch function, the first pitch component having an amplitude;

(b) determine a range of pitch components about a pitch component of a second pitch function corresponding to the first pitch component selected (c) selecting a second pitch component having a maximum amplitude from within the range of pitch components;

(d) summing the amplitude of the first pitch component with the maximum amplitude of the second pitch component to generate an enhanced pitch component; and repeating said steps of (a) through (d) for a predetermined number of pitch components of the plurality of pitch components of the first pitch function, to generate the plurality of enhanced pitch components.

9. The pitch determiner according to claim 8, wherein the first pitch function represents the pitch function of the current segment of speech, and wherein the second pitch function represents the pitch function of a succeeding segment of speech.

10. The pitch determiner according to claim 1, wherein the pitch within the segment of speech represents a first pitch candidate and wherein a largest amplitude of the plurality of enhanced pitch component represents a first magnitude, and wherein said pitch determiner further comprises:

a second pitch detector for detecting a second pitch of the current segment of speech having a current magnitude, by utilizing a pitch of a preceding segment of speech and the pitch function of the current segment of speech, the second pitch detected representing a second pitch candidate;

a summer for summing the current magnitude and magnitudes of selected pitch components for one or more preceding segments of speech to generate a second magnitude, the selected pitch components for each of the one or more preceding segments of speech being determined by the pitch function and pitch of a preceding segment of speech; and a candidate selector for selecting the first pitch candidate when a ratio of the first magnitude and the second magnitude is less than a threshold, and selecting the second pitch candidate when a ratio of the first magnitude and second magnitude is greater than or equal to the threshold.

11. The pitch determiner according to claim 10, wherein the threshold is calculated.

* * * * *